US007474590B2

(12) United States Patent
Watabe et al.

(10) Patent No.: US 7,474,590 B2
(45) Date of Patent: Jan. 6, 2009

(54) PRESSURE WAVE GENERATOR AND PROCESS FOR MANUFACTURING THE SAME

(75) Inventors: Yoshifumi Watabe, Tondabayashi (JP); Yoshiaki Honda, Seika-chou (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 34 days.

(21) Appl. No.: 11/568,419

(22) PCT Filed: Apr. 28, 2005

(86) PCT No.: PCT/JP2005/008252

§ 371 (c)(1),
(2), (4) Date: Oct. 27, 2006

(87) PCT Pub. No.: WO2005/107318
PCT Pub. Date: Nov. 10, 2005

(65) Prior Publication Data

US 2007/0217289 A1 Sep. 20, 2007

(30) Foreign Application Priority Data

| | | |
|---|---|---|
| Apr. 28, 2004 | (JP) | 2004-134312 |
| Apr. 28, 2004 | (JP) | 2004-134313 |
| Jun. 25, 2004 | (JP) | 2004-188785 |
| Jun. 25, 2004 | (JP) | 2004-188790 |
| Jun. 25, 2004 | (JP) | 2004-188791 |
| Sep. 27, 2004 | (JP) | 2004-280417 |

(51) Int. Cl.
*B06B 1/00* (2006.01)
*H04R 23/00* (2006.01)

(52) U.S. Cl. ..... 367/140; 381/164

(58) Field of Classification Search ..... 367/140; 381/164

See application file for complete search history.

(56) References Cited

U.S. PATENT DOCUMENTS

2002/0076070 A1 6/2002 Yoshikawa et al.
2005/0201575 A1 * 9/2005 Koshida et al. ..... 381/164

FOREIGN PATENT DOCUMENTS

| | | |
|---|---|---|
| JP | 3-140100 | 6/1991 |
| JP | 11-300274 | 11/1999 |
| JP | 2002-186097 | 6/2002 |

OTHER PUBLICATIONS

English Language Abstract of JP 3-140100.
English Language Abstract of JP 11-300274.
English Language Abstract of JP 2002-186097.

* cited by examiner

*Primary Examiner*—Ian J Lobo
(74) *Attorney, Agent, or Firm*—Greenblum & Bernstein, P.L.C.

(57) ABSTRACT

Even when compression stress is generated because a volume of a thermal insulation layer 2 is expanded due to oxidized by oxygen in the air, occurrence of cracks and fractures of the thermal insulation layer and a heating conductor 3 caused by the cracks are prevented by dispersing the compression stress. A pressure wave generator comprises a substrate 1, the thermal insulation layer 2 of porous material which is formed on a surface of the substrate 1 in thickness direction, and the heating conductor 3 of thin film formed on the thermal insulation layer 2, and generates pressure waves by heat exchange between the heating conductor 3 and a medium. When a thickness at the center of the thermal insulation layer 2 in width direction W is used as a reference thickness, and it is assumed that distribution of thickness of thermal insulation layer in the width direction is averaged with the reference thickness, porosity in an outer peripheral portion of the thermal insulation layer is made smaller than porosity in the center portion. By making the porosity in the outer peripheral portion of the thermal insulation layer 2 smaller, a number of immovable points on the outer periphery of the thermal insulation layer 2 restricted by the substrate 1 is increased and the positions of them are dispersed, so that the compression stress compressed in the outer peripheral portion of the thermal insulation layer 2 can be dispersed.

17 Claims, 33 Drawing Sheets

FIG. 3
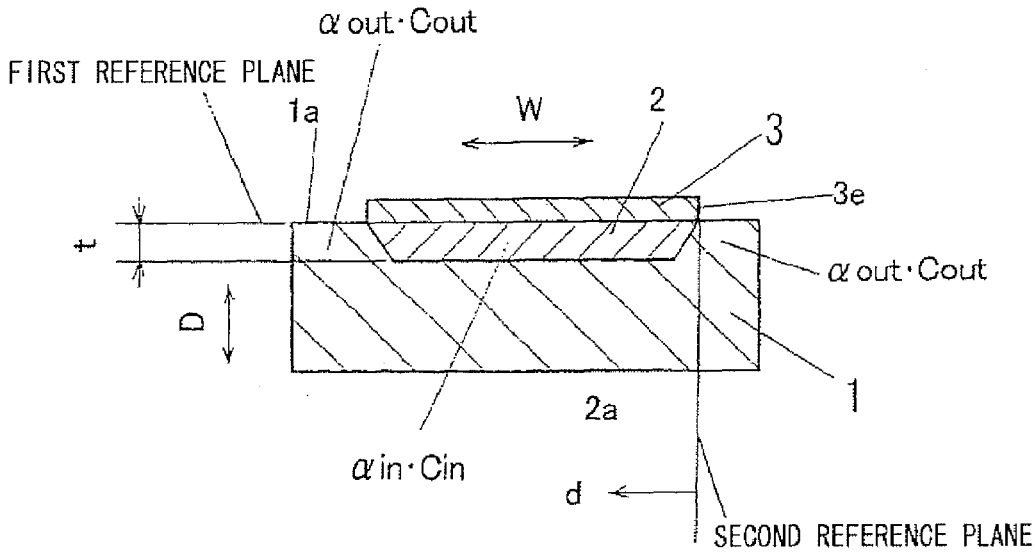
FIG. 4A
FIG. 4B
FIG. 4C
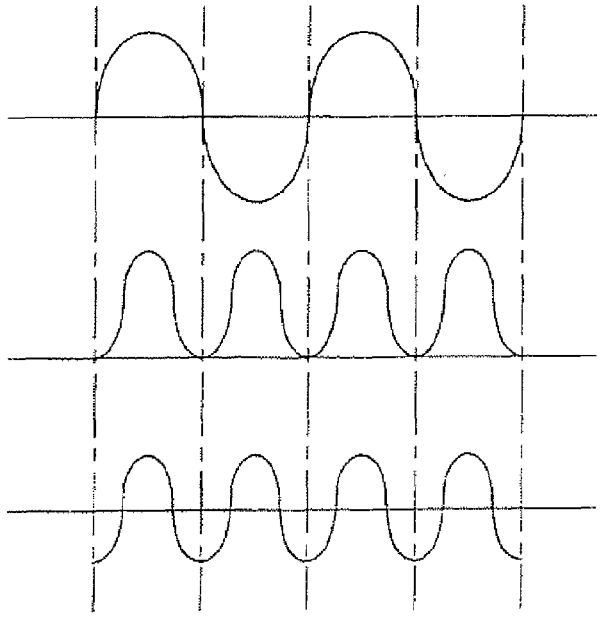

PRESSURE WAVE GENERATOR AND PROCESS FOR MANUFACTURING THE SAME

TECHNICAL FIELD

The present invention relates to a pressure wave generator for generating pressure waves such as acoustic waves for speaker, ultrasonic sounds or single pulse compressional wave and a process for manufacturing the same.

BACKGROUND ART

An ultrasonic wave generator utilizing mechanical vibrations of piezoelectric effect is conventionally known widely. In the ultrasonic wave generator utilizing mechanical vibrations, electrodes are provided on both sides of a crystal of piezoelectric material such as barium titanate, and electric energy is supplied between both electrodes so that mechanical vibrations are generated. Thus, ultrasonic waves are generated with vibrating medium such as air. The ultrasonic wave generator utilizing mechanical vibrations, however, has inherent resonance frequency, so that frequency bandwidth of ultrasonic waves generated thereby is narrower. In addition, the ultrasonic wave generator is easily affected by outside oscillation or drift of outside pressure.

On the other hand, for example, as described in Japanese Laid-Open Patent Publication No. 11-300274 or Japanese Laid-Open Patent Publication No. 2002-186097, a pressure wave generator utilizing a method for forming coarseness and minuteness of air with thermal induction by which heat is given to medium is suggested as a device generating ultrasonic waves without being accompanied with mechanical vibrations.

As shown in FIGS. 35 and 36B, the pressure wave generator utilizing thermal induction comprises a semiconductor substrate 1 of a single crystalline silicon substrate, a thermal insulation layer 2 formed in the semiconductor substrate 1 inwardly from a face to a predetermined depth in thickness direction of the semiconductor substrate 1, and a heating conductor 3 of metallic thin film (for example, Al thin film) formed on the thermal insulation layer 2. The thermal insulation layer 2 is formed of porous silicon layer, and has a heat conductivity and volume heat capacity, which are much smaller than those of the semiconductor substrate 1.

When alternating current is supplied to the heating conductor 3 from an AC power source Vs, the heating conductor 3 runs hot, and temperature (or calorific value) of the heating conductor 3 varies corresponding to frequency of the alternating current. On the other hand, since the thermal insulation layer 2 is formed just below the heating conductor 3 and the heating conductor 3 is thermally insulated from semiconductor substrate 1, heat exchange effectively occurs between the heating conductor 3 and air in the vicinity. Then, expansion and contraction of air is repeated corresponding to variation of temperature (or variation of calorific value) of the heating conductor 3. Consequently, pressure waves such as ultrasonic waves are generated (an arrow of direction shows traveling direction of pressure waves in FIG. 35).

Such a pressure wave generator utilizing thermal induction can widely vary frequency of ultrasonic waves by varying frequency of alternating voltage (drive voltage) applied to the heating conductor 3. Therefore, it can be used as an ultrasonic wave source or a sound source of a speaker.

According to the above-mentioned Japanese Laid-Open Patent Publication No. 11-300274, it is desirable to make heat conductivity and volume heat capacity of the thermal insulation layer 2 smaller than those of the semiconductor substrate 1. In addition, it is preferable that a product of the heat conductivity and the volume heat capacity of the thermal insulation layer 2 is much smaller than a product of the heat conductivity and the volume heat capacity of the semiconductor substrate 1. For example, when the semiconductor substrate 1 is formed of a single crystalline silicon substrate and the thermal insulation layer 2 is formed of porous silicon layer, the product of the heat conductivity and the volume heat capacity of the thermal insulation layer 2 becomes about 1/400 of the product of the heat conductivity and the volume heat capacity of the semiconductor substrate 1.

For forming the thermal insulation layer 2 of porous silicon layer in a side of a first surface of the semiconductor substrate 1 of a single crystalline silicon substrate, as shown in FIGS. 37A and 37B, a masking layer having an opening at a portion where the thermal insulation layer 2 is to be formed is formed on a face of the semiconductor substrate 1. Then, an energizing electrode 4 is entirely formed on another face of the semiconductor substrate 1 is used as an anode, and an electric current is supplied between a cathode that is disposed to face the face of the semiconductor substrate 1 in an electrolyte so as to perform anodization processing.

DISCLOSURE OF INVENTION

First Problem

By the way, while the pressure wave generator is used in a long term, a chemical change such as oxidization is produced in the thermal insulation layer 2 formed of poromeric material due to oxygen or moisture in the air. For example, table 1 shows element ratios as an example chemical change of oxidization due to long-term use in the air when the thermal insulation layer 2 made of porous silicon is exposed in 250 hours under high temperature and high humidity atmosphere of 85 degrees Celsius and 85% of humidity.

TABLE 1

| | Element Ratio (%) | |
|---|---|---|
| | O | Si |
| After Exposure | 38.5 | 61.5 |
| Before Exposure | 26.5 | 73.5 |

As can be seen from table 1, the element ratio of oxygen is largely increased from 26.5% to 38.5% in comparison with before and after the exposure, so that oxidization of porous silicon layer proceeds significantly. When the oxidization reaction proceeds in the thermal insulation layer formed of poromeric material, compression stress occurs in the thermal insulation layer due to volume expansion.

However, in the above mentioned conventional pressure wave generator, thickness of the thermal insulation layer 2 of the poromeric layer including peripheral portion is substantially uniform in an A-A section shown in FIG. 36B. Therefore, cubical expansion occurs in the thermal insulation layer 2 due to such as oxidation reaction in long-term use in the atmosphere, and thereby compression stress occurs. In a boundary portion where an outer periphery 2*e* of the thermal insulation layer 2 contacts with the semiconductor substrate 1, the bottom portion (point P2) of the thermal insulation layer 2 is restricted by the semiconductor substrate 1, so that it becomes an immovable point. Therefore, thermal stress generated in the thermal insulation layer 2 is concentrated at a point (point P1) where the outer periphery 2*e* of the thermal insulation layer 2 contacts with the surface of the semiconductor substrate 1. Thus, cracks occur in the vicinity of the point P1 of the thermal insulation layer 2 of the porous material, so that the thermal insulation layer 2 may be damaged. Such cracks proceed to the inside of the thermal insulation layer 2. When the cracks reach to the bottom of the heating conductor 3, cracks may occur in the peripheral portion of the heating conductor 3.

Under such a condition, when alternating current is applied between both ends of the heating conductor 3 as shown in FIG. 36A, the current may flow at end portions of the cracks of the heating conductor 3 in a concentrated manner, though the current naturally flows evenly if there is no crack in the heating conductor 3. Heating volume in the cracks of the heating conductor 3 may increase, and thereby, the cracks further proceed in the inside of the heating conductor 3 due to thermal stress. Finally, the heating conductor 3, itself may be broken.

Second Problem

In addition, in the pressure wave generator utilizing thermal induction, as shown in FIG. 36A, since the alternating current is supplied between both ends of the heating conductor 3 in longitudinal direction, the heating conductor 3 repeats expansion and contraction corresponding to on and off of the voltage of applied alternating current. Since the heating conductor 3 is thermally insulated from the semiconductor substrate 1, thermal stress, which is generated in the heating conductor 3 with a sudden temperature change of the heating conductor 3, may cause fracture of the heating conductor 3.

For designing the pressure wave generator utilizing thermal induction, a size of the pressure wave generator was selected to be about 15 mm×15 mm that was the general size of the ultrasonic generator utilizing mechanical vibration widely and conventionally used. The pressure wave generator utilizing thermal induction was driven for generating acoustic pressure equivalent to that of the ultrasonic generator utilizing mechanical vibration (for example, about 20 Pa with a frequency of 40 kHz at a position 30 cm distant from the sound source) so as to examine temperature of the heating conductor 3. As a result, it was found that the temperature of the heating conductor 3 became very high temperature more than 1,000 degrees momentarily.

An object of the present invention is to provide a pressure wave generator utilizing thermal induction by which a heating conductor and/or the thermal insulation layer are/is rarely fractured due to thermal stress and to provide the process of manufacture.

A pressure wave generator in accordance with an aspect of the present invention comprises a substrate, a thermal insulation layer of a porous material which is formed on a face of the substrate in thickness direction, and a heating conductor of thin film formed on the thermal insulation layer. Temperature of the heating conductor varies depending on waveforms of electric input to the heating conductor. The pressure wave generator generates pressure waves by heat exchange between the heating conductor and an atmosphere such as air. When a thickness at the center of the thermal insulation layer in width direction is used as a reference thickness, and it is assumed that distribution of thickness of thermal insulation layer in the width direction is averaged with the reference thickness, the porosity in a outer peripheral portion of the thermal insulation layer is made smaller than porosity in the center portion of the thermal insulation layer.

According such a configuration, in the pressure wave generator comprising the substrate, the thermal insulation layer of the porous material which is formed on the face of the substrate in thickness direction, and the heating conductor of thin film formed on the thermal insulation layer, and wherein the temperature of the heating conductor varies depending on waveforms of electric input to the heating conductor, and the pressure wave generator generates pressure waves by heat exchange between the heating conductor and an atmosphere such as air, when the thickness at the center of the thermal insulation layer in width direction is used as the reference thickness, and it is assumed that distribution of thickness of thermal insulation layer in the width direction is averaged with the reference thickness, the porosity in the outer peripheral portion of the thermal insulation layer is made smaller than porosity in the center portion of the thermal insulation layer. Thus, even when it is used in the atmosphere in a long term, and thereby, compression stress may occur because the volume of the thermal insulation layer expands due to chemical reaction such as oxidation of the thermal insulation layer, the compression stress can be dispersed by the outer peripheral portion of the thermal insulation layer where the porosity is made smaller. In other words, by making the porosity in the outer peripheral portion of the thermal insulation layer smaller, a number of immovable points in the outer periphery of the thermal insulation layer restricted by the substrate is increased and the positions of the points are dispersed in comparison with the conventional pressure wave generator, and thereby, the compression stress, which may be concentrated in the peripheral portion of the thermal insulation layer, can be dispersed. Consequently, it is possible to reduce the possibility of generation of cracks in the thermal insulation layer and to prevent occurrence of fracture of the heat conductor due to cracks of the thermal insulation layer. Furthermore, the fracture of the pressure wave generator can be prevented, and thereby ultrasonic wave can be generated stably in a long term.

Furthermore, a thickness in the peripheral portion of the thermal insulation layer may be formed thinner than that in the center portion.

In such a case, even when the volume of the thermal insulation layer is expanded due to chemical reaction such as oxidation of the thermal insulation layer in the long term use in the atmosphere, the compression stress, which was concentrated at a portion where the outer periphery of the thermal insulation layer contacts with the surface of the substrate in the conventional pressure wave generator, can be dispersed along the outer peripheral surface (such as an inclined face) of the thermal insulation layer in the outer peripheral portion of the thermal insulation layer. Consequently, it is possible to reduce the possibility of generation of cracks in the thermal insulation layer and to prevent occurrence of fracture of the heat conductor due to cracks of the thermal insulation layer. Furthermore, the fracture of the pressure wave generator can be prevented, and thereby ultrasonic wave can be generated stably in a long term.

Still furthermore, heat quantity radiated along the thickness direction of the substrate in the outer peripheral portion of the thermal insulation layer becomes larger than the heat quantity radiated along the thickness direction of the substrate in the center portion, so that mechanical strength of the thermal insulation layer and the heating conductor in the vicinity of the boundary between the substrate and the thermal insulation layer can be increased. Consequently, it is possible to prevent fractures of the thermal insulation layer and the heating conductor due to stress can be prevented. In addition, it is no need to change the materials and/or compositions of them, so that the pressure wave generator can be manufactured easily.

Alternatively, the porosity per unit volume in the outer periphery portion of the thermal insulation layer may be smaller than the porosity per unit volume in the center portion.

In such a case, since physicality in the outer peripheral portion of the thermal insulation layer is made uneven by changing the porosity per unit volume, the immovable points of the outer periphery of the thermal insulation layer restricted by the substrate can be dispersed in the region where the porosity per unit volume is varied. Thus, the compression stress, which was concentrated at a portion where the outer periphery of the thermal insulation layer contacts with the surface of the substrate in the conventional pressure wave generator, can be dispersed along the outer peripheral surface (such as an inclined face of the porosity) of the thermal insulation layer in the outer peripheral portion of the thermal insulation layer. Heat quantity radiated along the thickness direction of the substrate in the outer peripheral portion of the thermal insulation layer becomes larger than the heat quantity radiated along the thickness direction of the substrate in the center portion, so that mechanical strength of the thermal insulation layer and the heating conductor in the vicinity of the boundary between the substrate and the thermal insulation layer can be increased. In addition, it may combine with the feature of claim 2, that is, the thickness in the outer periphery portion of the thermal insulation layer is bade thinner than the thickness in the center portion.

Still furthermore, when a symbol $\alpha$ in designates a mean heat conductivity and a symbol Cin designates a mean volume heat capacity in the thickness direction of an inner portion than the outer periphery of the heating conductor, and a symbol $\alpha$ out designates a mean heat conductivity and a symbol Cout designates a mean volume heat capacity in the thickness direction of an outer portion than the outer periphery of the heating conductor, in an area in the widthwise direction which is defined by a reference thickness in the center portion of the thermal insulation layer in the widthwise direction from a surface of the substrate in the thickness direction toward the inside of the substrate, it may satisfy a condition of $\alpha$ in×Cin<$\alpha$ out×Cout and a value of $\alpha$ in×Cin may become larger approaching to outside in the vicinity of the boundary between the inner portion and the outer portion.

The present invention is based on a technical idea that a temperature gradient of outer peripheral portion of the heating conductor can be made gentle by boosting radiation amount to restrain a temperature rise of an outer peripheral portion of the heating conductor. Hereupon, it is found that radiation amount per a unit time can increased by raising a product of heat conductivity with volume heat capacity of the thermal insulation layer from the following relational expression.

$$T(\omega) = \frac{1-j}{\sqrt{2}} \cdot \frac{1}{\sqrt{\omega\alpha C}} \cdot q(\omega)$$

In addition, in the expression mentioned above, a symbol $\alpha$ designates a heat conductivity of the thermal insulation layer, a symbol C designates the volume heat capacity of the thermal insulation layer, a symbol $\omega$ designates an angular frequency of the alternating voltage applied between both ends of the heating conductor, a function $q(\omega)$ designates an electric energy input into the heating conductor and a function $T(\omega)$ designates a temperature of the heating conductor.

In this way, when the mean heat conductivity is designated by the symbol $\alpha$ in and the mean volume heat capacity is designated by the symbol Cin in the thickness direction of the inner portion than the outer periphery of the heating conductor, and the mean heat conductivity is designated by the symbol $\alpha$ out and the mean volume heat capacity is designated by the symbol Cout in the thickness direction of the outer portion than the outer periphery of the heating conductor, the condition of $\alpha$ in×Cin<$\alpha$ out×Cout is satisfied and the value of $\alpha$ in×Cin becomes larger approaching to outside in the vicinity of the boundary between the inner portion and the outer portion. Thus, the heat quantity radiated along the thickness direction of the substrate in the outer peripheral portion of the thermal insulation layer becomes larger than the heat quantity radiated along the thickness direction of the substrate in the center portion, so that the thermal stress acting on the heating conductor can be reduced in comparison with that of the conventional pressure wave generator. Thereby, fracture of the heating conductor due to the thermal stress hardly occurs in comparison with the conventional pressure wave generator, and thereby enabling longer operating life of the pressure wave generator. In other words, even when the thermal stress occurs due to expansion and contraction of the heating conductor corresponding to temperature rise and temperature fall of the heating conductor in the driving of the pressure wave generator, the heating conductor is rarely broken so that the ultrasonic can be generated stably in a long term.

BRIEF DESCRIPTION OF DRAWINGS

FIG. 3 is a conceptual drawing showing the configuration of the pressure wave generator in accordance with the second embodiment.

FIG. 4A is a waveform chart showing a waveform of alternating voltage applied to the pressure wave generator.

FIG. 4B is a waveform chart showing variation of temperature of the heating conductor.

FIG. 4C is a waveform chart showing a waveform of a pressure wave (an acoustic wave) generated by the pressure wave generator.

BEST MODE FOR CARRYING OUT THE INVENTION

First Embodiment

Figure 1A:
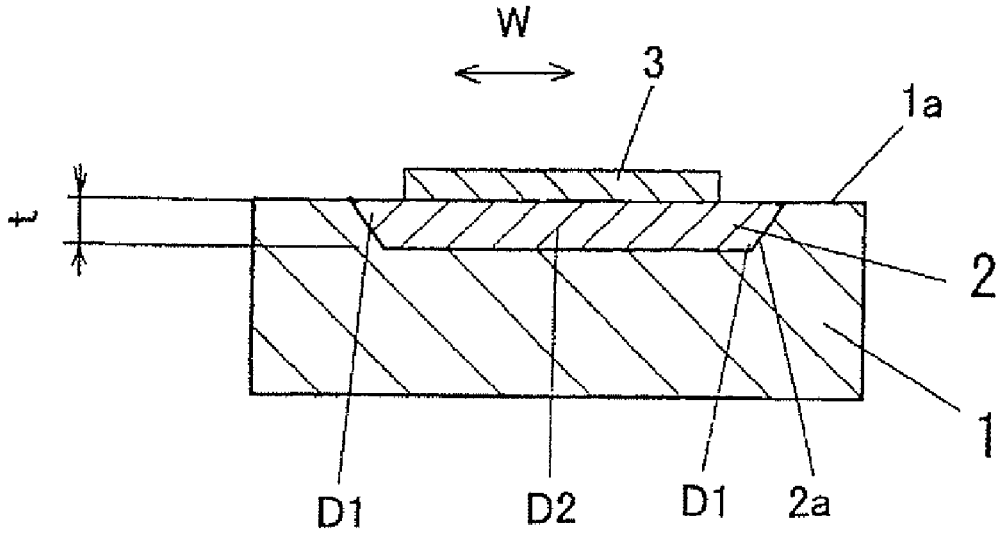
FIG. 1A is a sectional view showing a structural example of a pressure wave generator in accordance with a first embodiment of the present invention.

A first embodiment of the present invention is described. FIG. 1A is a sectional view showing an essential structure of a pressure wave generator in accordance with the first embodiment. As shown in FIG. 1A, the pressure wave generator comprises a substrate 1 which is made of, for example, a semiconductor substrate, a thermal insulation layer 2 of a porous material such as porous silicon layer which is formed on a surface (first surface) of the substrate 1 in thickness direction, and a heating conductor 3 of a thin film such as an aluminum thin film which is formed on the thermal insulation layer 2. Such pressure wave generator generates pressure waves by heat exchange between the heating conductor 3 and a medium such as air when the temperature of the heating conductor 3 varies corresponding to waveforms of electric input to the heating conductor 3.

In the pressure wave generator in accordance with the first embodiment, when it is assumed that distribution of the thickness of the thermal insulation layer 2 in widthwise direction "W" is averaged by a reference thickness "t" where the thickness "t" in a center portion of the thermal insulation layer 2 in the widthwise direction is used as the reference thickness, a porosity "D1" in an outer periphery portion of the thermal insulation layer 2 is made smaller than a porosity "D2" in the center portion. This structure corresponds to the above mentioned first problem. Since magnitude correlation between the thermal insulation layer 2 and the heating conductor 3 is not especially limited, the heating conductor 3 is formed on the inward of the outer periphery of the thermal insulation layer 2 in the example shown in FIG. 1A. In addition, slanted faces 2*a* are formed in the outer peripheral portion of the thermal insulation layer 2, so that the porosity in the outer periphery portion of the thermal insulation layer 2 in the widthwise direction of the semiconductor substrate 1 is made smaller than the porosity in the center portion.

Figure 36A:
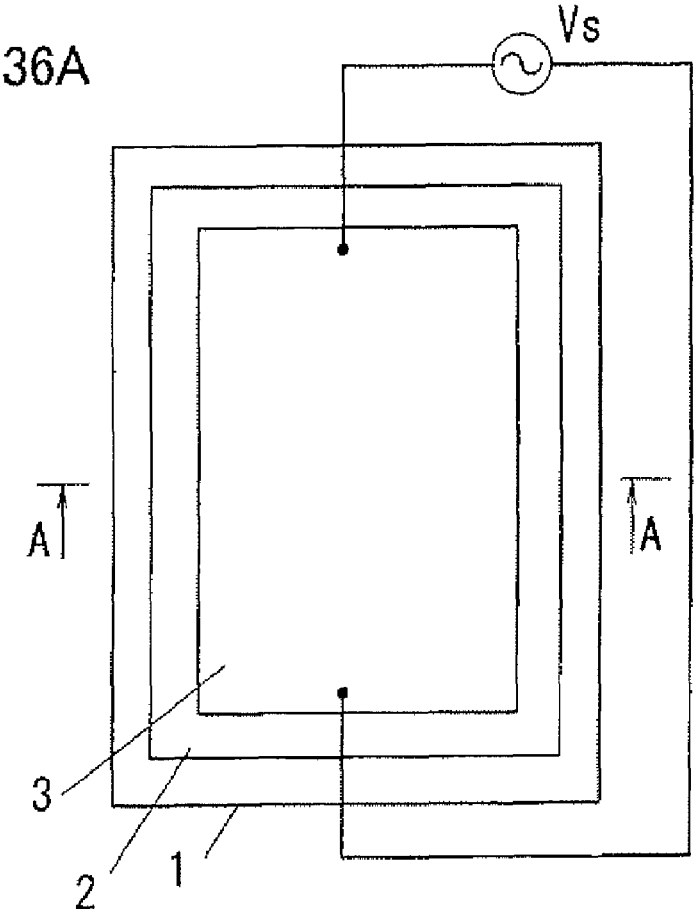
FIG. 36A is a plain view showing the configuration of the conventional pressure wave generator.
Figure 36B:
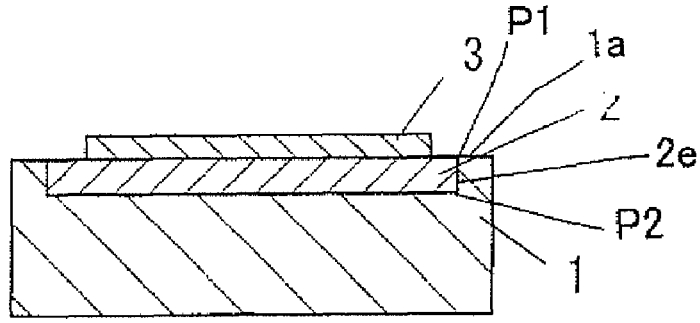
FIG. 36B is an A-A sectional view of FIG. 36A.

According to such a structure, even when the pressure wave generator is used in the atmosphere in a long term, and even when a volume of the thermal insulation layer 2 is expanded due to chemical reaction such as oxidation of the thermal insulation layer, the compression stress, which is concentrated at the portion (point P1) where the outer periphery 2*e* of the thermal insulation layer 2 contacts with the surface of the semiconductor substrate 1 in the conventional pressure wave generator shown in FIG. 36B can be dispersed along the slanted faces 2*a* in the outer peripheral portion of the thermal insulation layer 2. Consequently, the possibility of occurrence of cracks in the thermal insulation layer 2 can be reduced, and thereby, fracture of the heating conductor 3 due to the cracks in the thermal insulation layer 2 can be prevented. In addition, fracture of the pressure wave generator can be prevented so that ultrasonic waves can be generated stably in a long term.

Furthermore, heat quantity radiated along the thickness direction of the substrate in the peripheral portion becomes larger in comparison with heat quantity radiated along the thickness direction of the substrate in the center portion, so that mechanical strength of the thermal insulation layer 2 and the heating conductor 3 in the vicinity of a boundary between the semiconductor substrate 1 and the thermal insulation layer 2 can be increased. Consequently, fracture of the thermal insulation layer 2 and the heating conductor 3 due to stress can be prevented.

Figure 1B:
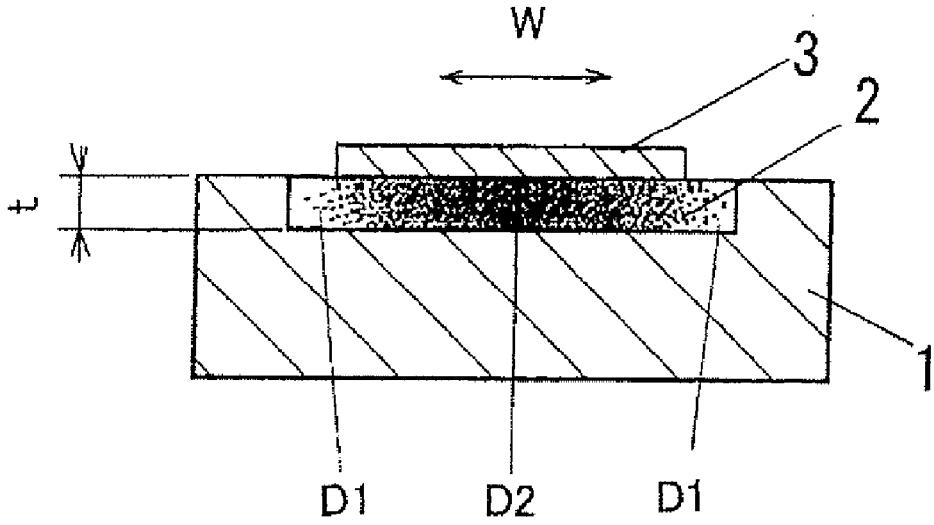
FIG. 1B is a sectional view showing another structural example.

Besides, the method that makes the porosity "D1" in the outer peripheral portion of the thermal insulation layer 2 smaller than the porosity "D2" in the center portion is not limited to the above mentioned method of providing the slanted surfaces 2*a* in the outer peripheral portion of the thermal insulation layer 2 so that the thickness in the outer periphery portion is bade smaller than the thickness in the center portion. As shown in FIG. 1B, it is possible that the porosity per unit volume in the outer peripheral portion on the thermal insulation layer 2 is made smaller than the porosity per unit volume in the center portion. In that case, since the physicality in the outer peripheral portion of the thermal insulation layer 2 is made uneven by varying the porosity per unit volume, immovable points on the outer periphery of the thermal insulation layer 2 restricted by the semiconductor substrate 1 is dispersed in the area where the porosity per unit volume is varied. Thus, the compression stress, which is concentrated at the portion (point P1) where the outer periphery 2*e* of the thermal insulation layer 2 contacts with the surface of the semiconductor substrate 1 in the conventional pressure wave generator, can be dispersed along the outer peripheral surface of the thermal insulation layer 2 (such as an inclined portion of porosity). Since heat quantity radiated along the thickness direction of the semiconductor substrate in the outer peripheral portion of the thermal insulation layer 2 becomes larger than heat quantity radiate along the thickness direction of the semiconductor substrate in the center portion, the mechanical strength of the thermal insulation layer 2 and the heating conductor 3 in the vicinity of the boundary between the semiconductor substrate 1 and the thermal insulation layer 2 can be increased. Still furthermore, it is possible to combine the feature shown in FIG. 1A that the thickness in the outer peripheral portion of the thermal insulation layer 2 is made smaller than the thickness in the center portion.

In summarizing the effects of the first embodiment, even when the compression stress occurs due to expansion of the volume of the thermal insulation layer 2 by chemical reaction such as oxidation of the thermal insulation layer 2 in a long term use in the atmosphere, the compression stress can be dispersed by the portion where the porosity is smaller in the outer peripheral portion of the thermal insulation layer 2. In other words, a number of immovable points on the outer periphery of the thermal insulation layer 2 restricted by the semiconductor substrate 1 is increased and the positions of them are dispersed in comparison with the conventional pressure wave generator, so that the compression stress concentrated in the outer peripheral portion of the thermal insulation layer 2 can be dispersed. Consequently, the possibility of occurrence of cracks in the thermal insulation layer 2 can be reduced, and thereby, fracture of the heating conductor 3 due to the cracks in the thermal insulation layer 2 can be prevented. In addition, fracture of the pressure wave generator can be prevented so that ultrasonic waves can be generated stably in a long term.

Second Embodiment

Figure 2A:
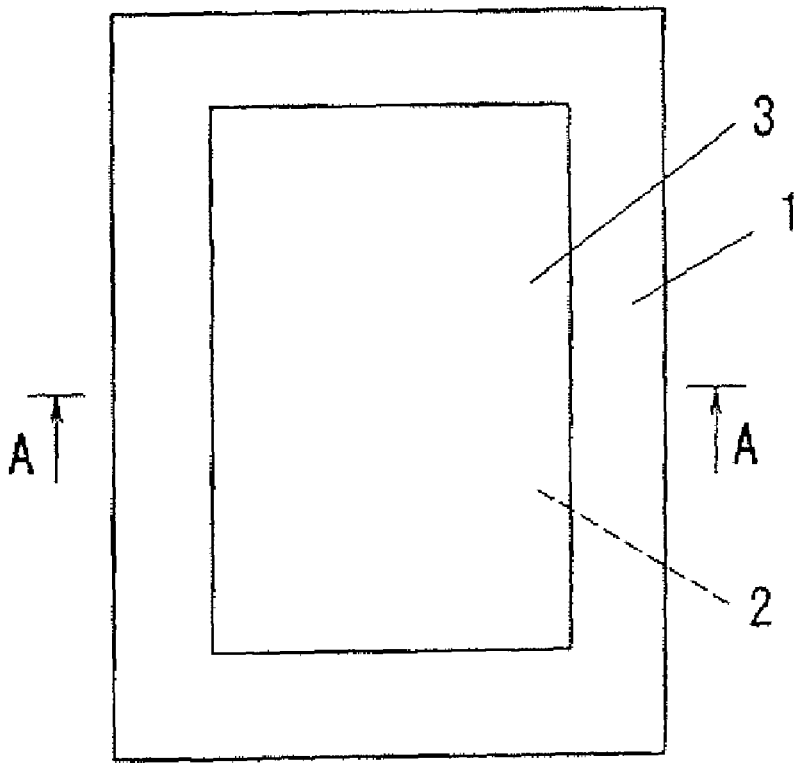
FIG. 2A is a plain view showing a configuration of a pressure wave generator in accordance with a second embodiment of the present invention.
Figure 2B:
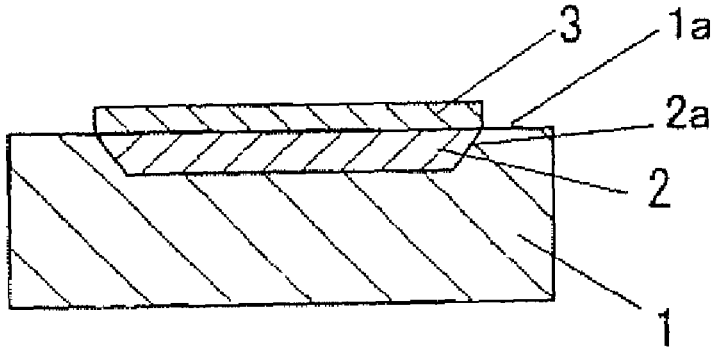
FIG. 2B is an A-A sectional view in FIG. 2A.

A first embodiment of the present invention is described. FIG. 2A is a plain view of a pressure wave generator in accordance with the second embodiment. FIG. 2B is an A-A sectional drawing in FIG. 2A.

As shown in FIG. 2B, the pressure wave generator of the second embodiment comprises a semiconductor substrate (substrate) 1 of p-type single crystalline silicon substrate, a thermal insulation layer 2 of porous silicon layer (porous material), which is formed inwardly to an inside of the semiconductor substrate 1 from a surface (first surface) 1*a* of the semiconductor substrate 1 in thickness direction thereof, and a heating conductor 3 of thin film (such as a metal thin film, for example, aluminum thin film) formed on the thermal insulation layer 2. As shown in FIG. 2A, a planar shape of the semiconductor substrate 1 is rectangular (for example, oblong), and planar shapes of the thermal insulation layer 2 and the heating conductor 3 are formed to rectangular (for example, oblong), too. As an example, lengths of longer side and shorter side of the heating conductor 3 are respectively set to 12 mm and 10 mm. In addition, a thickness of the semiconductor substrate 1 is set to be 525 μm, a thickness of the thermal insulation layer 2 is set to be 10 μm, and a thickness of the heating conductor 3 is set to 50 nm. Besides, these measures are not things limited in particular.

In addition, as shown in FIG. 2B, the thermal insulation layer 2 is formed by approximately uniform thickness to reach to a predetermined depth, except the portions which face the outer peripheral portion of the heating conductor 3, in widthwise direction which is perpendicular to the thickness direction of the semiconductor substrate 1 (including both of longer side direction and shorter side direction of the above rectangular). Furthermore, inclined portions 2*a* are formed in the portions of the thermal insulation layer 2 facing the outer peripheral portions of the heating conductor 3 in a manner so that thickness of the thermal insulation layer 2 becomes smaller approaching to the outer periphery. In other words, when it is assumed that distribution of the thickness of the thermal insulation layer 2 in widthwise direction is averaged by a reference thickness where the thickness in the center portion of the thermal insulation layer 2 in the widthwise direction is used as the reference thickness, the porosity in the outer periphery portion of the thermal insulation layer 2 is made smaller than the porosity in the center portion by the inclined portions 2*a* in the second embodiment.

Figure 15C:
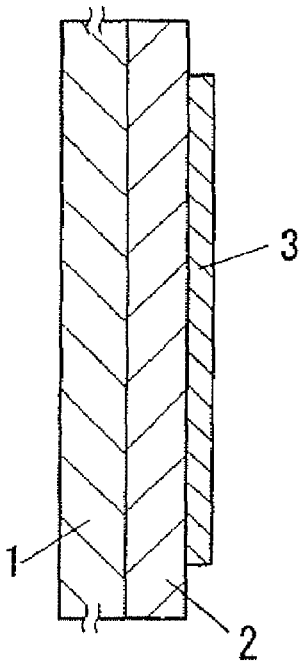
FIG. 15C is a B-B sectional view in FIG. 15A.

In the pressure wave generator, the heating conductor 3 is run a fever due to energization (feeding of electric energy) of electric input (for example, alternating current), in which voltage and/or current are/is varied temporally, to the heating conductor 3, so that temperature (heat value) of the heating conductor 3 is varied temporally. Then, pressure waves (for example, ultrasonic waves) are generated by heat exchange between the heating conductor 3 and a medium (for example, air). When alternating voltage of the sinusoid which is, for example, shown in FIG. 4A is applied to both endpoints of the heating conductor 3 in longitudinal direction from an AC power source (cf. Vs of FIG. 15), the temperature of the heating conductor 3 will be varied as shown in FIG. 4B due to occurrence of Joule heat. In addition, pressure waves (acoustic waves) having a waveform shown in FIG. 4C will be generated with the temperature change of the heating conductor 3.

The porous single crystalline silicon layer which constitutes the thermal insulation layer 2 is formed by performing an anodization processing to a part of p-type silicon substrate as the semiconductor substrate 1 in electrolyte, which will be described in process of manufacture, later. In addition, porosity of the thermal insulation layer 2 can be varied by changing conditions of the anodization processing, appropriately. As porosity rises, heat conductivity and volume heat capacity of the porous silicon layer decrease. Thus, the heat conductivity of the porous silicon layer can be made much smaller than that of the single crystalline silicon by setting the porosity of the porous silicon layer, appropriately.

Hereupon, the heat conductivity of the thermal insulation layer 2 just below the heating conductor 3 is designated by a symbol $\alpha$, the volume heat capacity of the thermal insulation layer 2 is designated by a symbol C, an angular frequency of alternating voltage of the sinusoid applied to the heating conductor 3 is designated by a symbol $\omega$, and the temperature of the heating conductor 3 is shown by a function $T(\omega)$ (assuming the temperature T as a function of $\omega$). With respect to a distance (depth) from a surface of the thermal insulation layer 2 in thickness direction of the semiconductor substrate 1, a thermal diffusion length L is defined as a distance that a temperature at the length becomes 1/e times (e, base of natural logarithm) of the temperature on the surface of the thermal insulation layer 2. The thermal diffusion director L is shown by the following formula.

$$L \cong \sqrt{(2\alpha/\omega C)}$$

It is desirable that the thermal insulation layer 2 has a thickness of around 0.5 to 3 times of the thermal diffusion length L.

Figure 35:
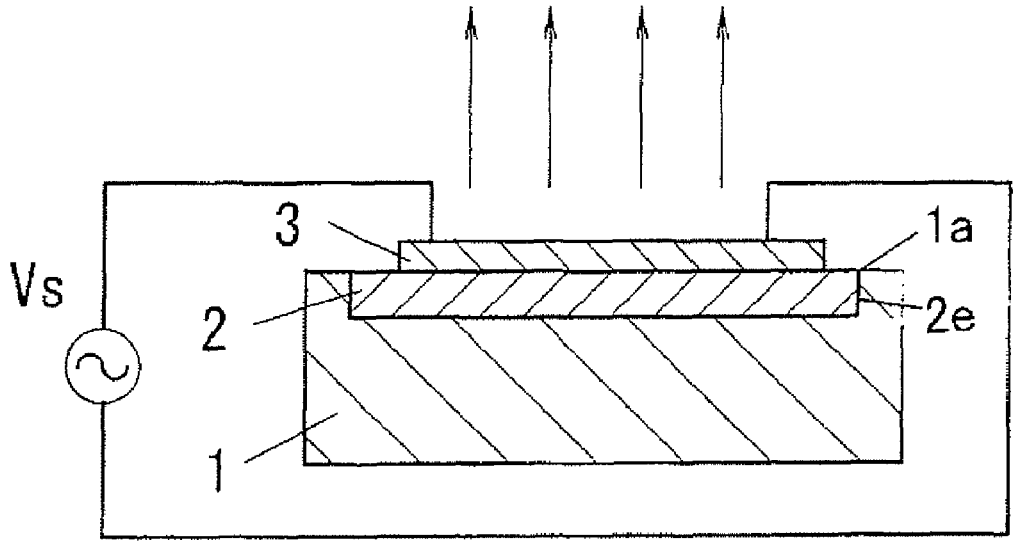
FIG. 35 is a sectional view showing a configuration of a conventional pressure wave generator.

In the pressure wave generator of the second embodiment, as shown in FIG. 2B, the inclined portions 2*a* are formed so that the thickness of the portion facing the outer periphery portion of the heating conductor 3 becomes thinner as approaching to the outer periphery. In such pressure wave generator, simulation of temperature distribution on a plane, which includes a surface of the thermal insulation layer 2 in the vicinity of the outer periphery of the heating conductor 3 (boundary between the thermal insulation layer 2 and the heating conductor 3) and the first surface 1*a* of the semiconductor substrate 1, was performed by finite element method, in a condition that the heating conductor 3 was energized (feeding of electric energy). A consequence of the simulation with respect to the pressure wave generator in the first embodiment is shown as a characteristic curve designated by a symbol "A" in FIG. 8. In addition, a consequence that performed similar simulation about a conventional pressure wave generator shown in FIG. 35 is shown as a characteristic curve designated by a symbol "B" in FIG. 8.

Figure 2C:
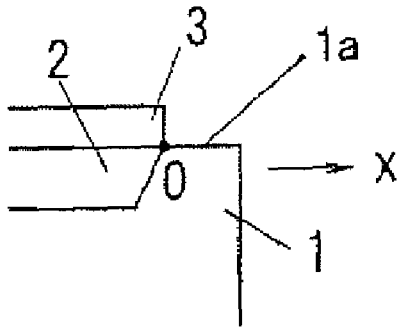
FIG. 2C is a narrative drawing showing reference points when simulation of temperature distribution of a plane including a first surface of a semiconductor substrate and a surface of a thermal insulation layer by finite element method.
Figure 8:
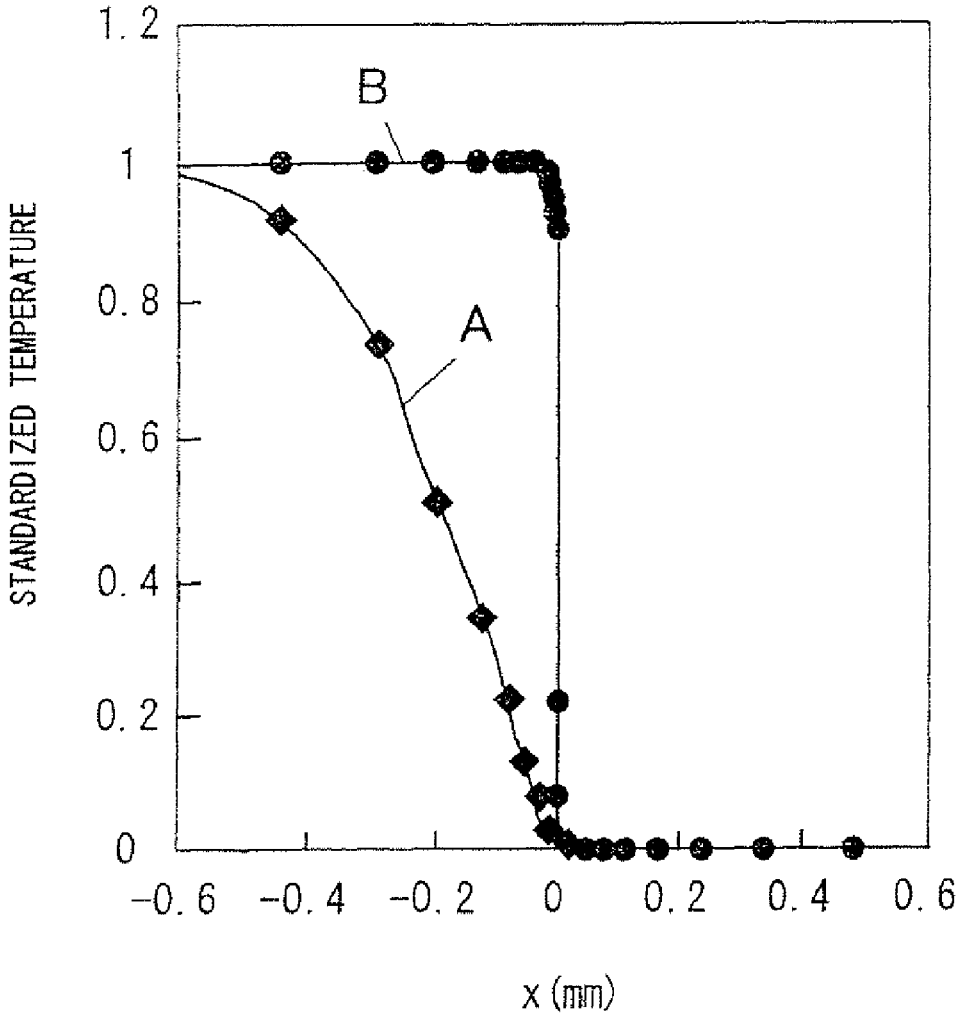
FIG. 8 is a graph showing temperature distribution characteristics of the pressure wave generator in accordance with the second embodiment and of the conventional pressure wave generator.
Figure 36C:
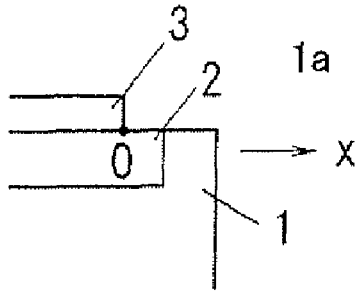
FIG. 36C is a narrative drawing showing reference points when simulation of temperature distribution of a plane including a first surface of a semiconductor substrate and a surface of a thermal insulation layer by finite element method.

The characteristic curves designated by symbols "A" and "B" in FIG. 8 are the consequences of the simulations of the temperature distribution of the planes including the first surface 1*a* of the semiconductor substrate 1 under conditions that a contact point of the thermal insulation layer 2 in a section of shorter side direction of the heating conductor 3 (A-A section) and the outer peripheral of the heating conductor 3 is defined as origin "O", and a direction departing from the thermal insulation layer 2 (right hand in FIGS. 2C and 36C) is defined as positive in X-direction, as shown in FIGS. 2C and 36C. In addition, numeric data disclosed in the above-mentioned Japanese Laid-Open Patent Publication No. 11-300274 were used as the heat conductivity and volume heat capacity when the simulations were performed. A value of the heat conductivity of the semiconductor substrate 1 of single crystalline silicon substrate was 168 W/(m·k), a value of the volume heat capacity of the heat conductivity of the semiconductor substrate 1 was $1.67\times10^6$ J/($m^3$·k), a value of the heat conductivity of the thermal insulation layer 2 of porous silicon layer with porosity of 60% was 1 W/(m·k), and a value of the volume heat capacity of the thermal insulation layer 2 was $0.7\times10^6$ J/($m^3$·k).

As can be seen from FIG. 8, in both of the pressure wave generator in the second embodiment and the conventional pressure wave generator, there are temperature gradients (−dT/dx) along X-axis direction. However, the temperature gradient of the pressure wave generator of the second embodiment is much slower than that of the conventional pressure wave generator. As for the reason, since the inclined portions 2*a* are formed in a manner so that the thickness of the thermal insulation layer 2 becomes thinner as approaching to the outer periphery in the portion facing the outer peripheral portion of the heating conductor 3 in the pressure wave generator of the second embodiment, heat quantity radiated along the thickness direction of the semiconductor substrate 1 in the inclined portions 2*a* becomes larger than that in the center portion of the heating conductor 3.

In the pressure wave generator of the second embodiment shown in FIG. 3, it is assumed that a symbol $\alpha$ in designates a mean heat conductivity and a symbol Cin designates a mean volume heat capacity in the thickness direction of an inner portion than the outer periphery 3*e* of the heating conductor 3, and a symbol α out designates a mean heat conductivity and a symbol Cout designates a mean volume heat capacity in the thickness direction of an outer portion than the outer periphery 3*e* of the heating conductor 3, in an area in the widthwise direction which is defined by the reference thickness "t" in the center portion of the thermal insulation layer 2 in the widthwise direction from the surface (first surface) 1*a* of the semiconductor substrate 1 in the thickness direction toward the inside of the semiconductor substrate 1. The pressure wave generator of the second embodiment satisfies a condition of α in×Cin<α out×Cout, and a value of α in×Cin becomes larger as approaching to outside in the vicinity of the boundary between the inner portion and the outer portion. In brief, the larger a product of heat conductivity with volume heat capacity become, the higher the heat radiation characteristics is, so that radiation amount per a unit time can be increased. In the second embodiment, temperature gradient in the vicinity of the outer peripheral portion of the heating conductor 3 is made gentle by making the heat radiation characteristics of the thermal insulation layer 2 in a portion just below the vicinity of the outer peripheral portion of the heating conductor 3 higher than that of the thermal insulation layer 2 in a portion just below the center portion of the heating conductor 3.

In this way, in the pressure wave generator of the second embodiment, the heat quantity radiated along the thickness direction of the semiconductor substrate 1 in the outer peripheral portion of the heating conductor 3 becomes larger than the heat quantity radiated in the center portion of the heating conductor 3. Thus, thermal stress applied to the heating conductor 3 can be reduced in comparison with the conventional pressure wave generator, and fracture of the heating conductor 3 due to thermal stress rarely occurs. Consequently, the pressure wave generator can be made longevity life.

In addition, in the area defined by the reference thickness "t" in the width direction "W", a boundary of the area where the value of α in×Cin varies, (that is, boundary edge of the inclined portion 2*a*) is coincided with the outer periphery of the heating conductor 3, so that it is possible to restrain the degradation of amplitude of the pressure wave, without increasing heat quantity radiated from the outer peripheral portion of the heating conductor 3 to the semiconductor substrate 1 much, while physicality of the outer peripheral portion of the thermal insulation layer 2 are made substantially the same as that in the center portion of the thermal insulation layer 2, in other words, the physicality of the porous silicon layer which forms the thermal insulation layer 2 uniformly.

Figure 5A:
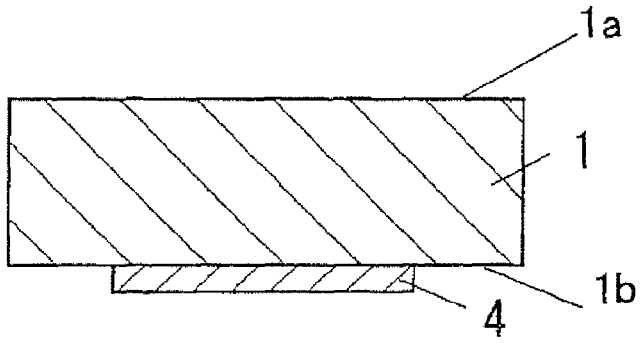
FIGS. 5A to 5C are process drawings showing processes of manufacture of the pressure wave generator in accordance with the second embodiment.
Figure 5B:
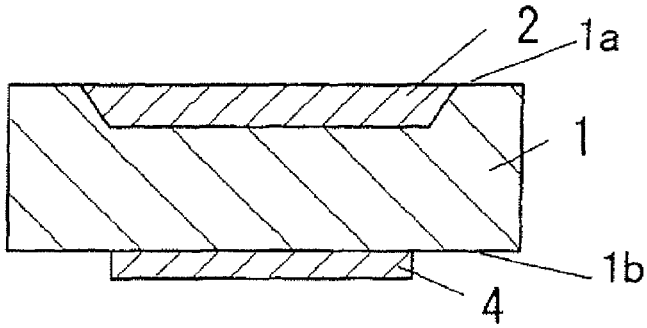
Figure 5C:
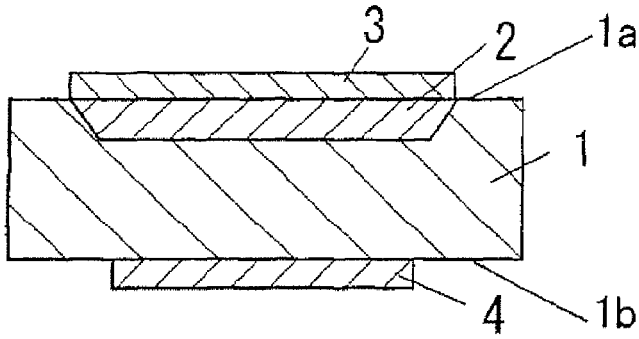
Figure 6:
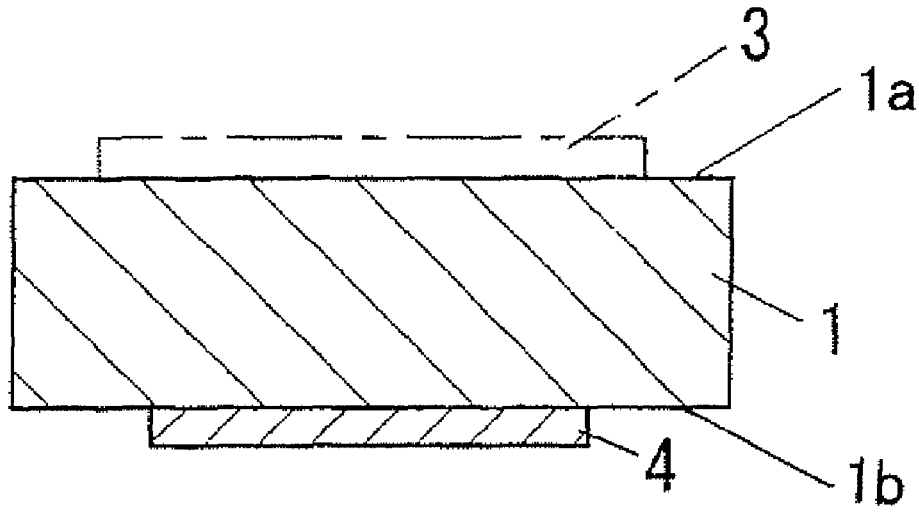
FIG. 6 is a process drawing showing another process of manufacture of the pressure wave generator in accordance with the second embodiment.

Subsequently, process of manufacture of the pressure wave generator in the second embodiment is described with reference to FIGS. 5A to 5C, 6 and 7. As shown in FIG. 5A, an energizing electrode 4 having a rectangular planar shape and used for anodization is formed on another surface (second surface) 1*b* of the semiconductor substrate 1 of p-type silicon substrate. As shown in FIG. 6, the center of the energizing electrode 4 coincides with the center of an area 3*a* to which rectangular shaped heating conductor 3 is formed (abbreviated as heating conductor forming area), in a plane parallel to the first surface 1*a* of the semiconductor substrate 1. In addition, overall length of each side of the energizing electrode 4 is set to be shorter by a predetermined contraction measure than overall length of each corresponding side of the heating conductor forming area 3*a*.

In a process for forming the energizing electrode 4, for example, a film of an electrically conductive layer is formed on the second surface 1*b* of the semiconductor substrate 1 by sputtering method or vacuum deposition. Subsequently, an unnecessary portion except a portion used for the energizing electrode 4 among the electrically conductive layer is removed with using a photolithography technique and an etching technique. In the second embodiment, lengths of the longer side and the shorter side of the heating conductor forming area 3*a* were respectively set to be 12 mm and 10 mm, and the contraction measure was set to be 1 mm. Since the energizing electrode 4 is smaller than he heating conductor forming area 3*a*, lengths of the longer side and the shorter side of the energizing electrode 4 were respectively set to be 11 mm and 9 mm. Besides, these numeric values are not limited in particular.

After forming the energizing electrode 4, an end of a lead wire (it is not illustrated) for energization is connected to the energizing electrode 4, and the energizing electrode 4 and the end of the lead wire are coated by sealant having hydrofluoric acid proof so as not touched the electrolyte used for anodization processing. Subsequently, the anodization processing is performed with using an anodization apparatus shown in FIG. 7. The thermal insulation layer 2 of porous silicon layer shown in FIG. 5B is formed on the semiconductor substrate 1. By performing a heating conductor forming processing to the heating conductor forming area 3*a* on the first surface 1*a* of the semiconductor substrate 1 afterwards, a structure having the heating conductor 3 shown in FIG. 5C is obtained.

Figure 7:
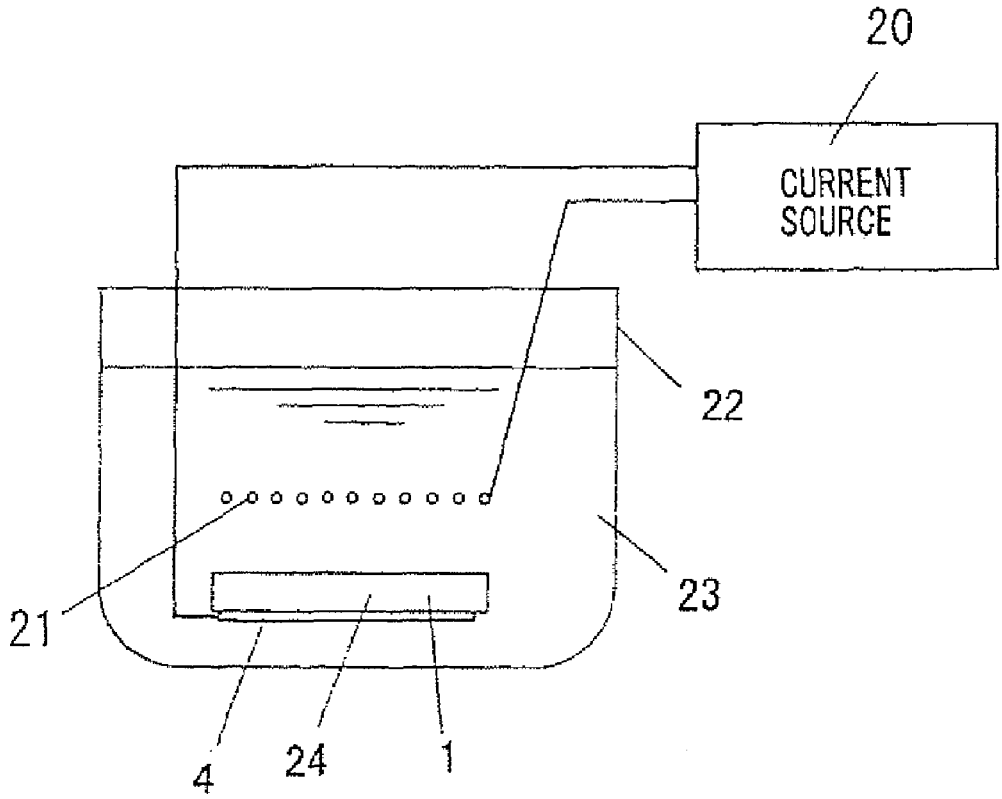
FIG. 7 is a drawing showing a configuration of an anodization apparatus used for process of manufacture of the pressure wave generator in accordance with the second embodiment.

According to the process of manufacture of the pressure wave generator of the second embodiment, the thermal insulation layer 2 is formed by the anodization processing. In the anodization processing, an object 24 to be processed having the semiconductor substrate 1 as a main component is dipped into an electrolyte 23 in a processing tank 22, as shown in FIG. 7. Subsequently, a platinum electrode 21 is arranged to face the first surface 1*a* of the semiconductor substrate 1 in the electrolyte 23. Furthermore, the lead wire connected to the energizing electrode 4 is connected to plus side and the platinum electrode 21 is connected to minus side of a current source 20, respectively. Then, a current with a predetermined current density (for example, 20 mA/cm$^2$) is flown in a predetermined term (for example, eight minutes) between the energizing electrode 4 and the platinum electrode 2 from the current source 20, while using the energizing electrode 4 as an anode and the platinum electrode 21 as a cathode.

By such anodization processing, the thermal insulation layer 2 that the thickness is approximately uniformity (for example, 10 μm) except the outer peripheral portion is formed by the first surface 1*a* side of the semiconductor substrate 1. The object 24 to be processed is taken out from the processing tank 22, the sealant is removed from the object 24 to be processed, and the lead wire connected to the energizing electrode 4 is taken off, afterwards.

Besides, the conditions in the anodization processing are not limited in particular. For example, the current density should be set in a range of 1 to 500 mA/cm$^2$, appropriately. In addition, the term for running the current should be set depending on a thickness of the thermal insulation layer 2, appropriately.

As for an electrolyte used in the anodization processing, a mixture of an aqueous solution of hydrogen fluoride of 55 wt % and ethanol by 1:1 is used. As for the sealant, a sealant of the fluoroplastic such as Teflon can be used.

In forming of the heating conductor 3, a metal thin film (for example, aluminum thin film) for the heating conductor 3 is formed by sputtering method on the first surface 1*a* of the semiconductor substrate 1. Photo resist is spread on the metal thin film, and a patterned resist layer for forming the heating conductor 3 (not illustrated) is formed by a photolithography technique afterwards. Then, the resist layer is used as a mask for removing an unnecessary portion of the metal thin film by a dry-etching processing, so that the heating conductor 3 is formed. Finally, the structure shown in FIG. 5C is provided by removing the resist layer.

Generally, when the dimensions of the energizing electrode 4 is made a little smaller than those of the thermal insulation layer 2 to be formed, and the dimensions of the platinum electrode 21 are made larger than those of the thermal insulation layer 2, direction of electric field inclines in the outer peripheral portion of the thermal insulation layer 2 to be formed, and the outside comes to have a weak field strength. Thus, when the anodization processing is performed under such a condition, electric current flowing to the outer peripheral portion of an area on the semiconductor substrate 1 on which the thermal insulation layer 2 is formed becomes fewer, so that a thickness of an oxide film formed on the first surface 1*a* of the semiconductor substrate 1, that is, the thermal insulation layer 2 becomes thinner at a portion as approaching to the outer periphery thereof. Therefore, the inclined portions 2*a* are formed in a manner so that the thickness becomes gradually thinner as approaching to outside in the outer peripheral portion of the thermal insulation layer 2 formed on the first surface 1*a* of the semiconductor substrate 1, as shown in FIG. 2B. As a result, in comparison with the conventional pressure wave generator thermal stress applied to the heating conductor 3 can be reduced in the pressure wave generator of the second embodiment, and fracture of the heating conductor 3 due to thermal stress rarely occurs.

When a cross-sectional shape of the thermal insulation layer 2 was observed with a scanning electron microscope, it as found that a boundary between the thermal insulation layer 2 and the semiconductor substrate 1 was slanted as the deeper a depth from a first reference plane including the first surface 1*a* of the semiconductor substrate 1 becomes, the longer a distance "d" in width direction "W" from a second reference plane including the outer periphery or edge of the heating conductor 3 becomes, with reference to FIG. 3. Specifically, it was confirmed that the distance from the second reference plane of the heating conductor 3 was about 0.5 mm at a position from the depth of 10 μm from the first reference plane.

By making the energizing electrode 4 smaller than the heating conductor forming area 3*a* as mentioned above, it is possible that the outer peripheries of the inclined portions 2*a* of the thermal insulation layer 2 are substantially coincided with the outer periphery of the heating conductor 3, or located inward than the outer periphery of the heating conductor 3. More specifically, when the overall length of each side of the energizing electrode 4 is shortened only by 1 mm than the overall length of each side of the heating conductor forming area 3*a* as mentioned above (the contraction measure was set to 1 mm), the outer peripheries of the inclined portions 2*a* of the thermal insulation layer 2 are substantially coincided with the outer periphery of the heating conductor 3. On the other hand, when the overall length of each side of the energizing electrode 4 is shortened only by 2 mm than the overall length of each side of the heating conductor forming area 3*a* as mentioned above (the contraction measure was set to 2 mm), the outer peripheries of the inclined portions 2*a* of the thermal insulation layer 2 are formed inward than the outer periphery of the heating conductor 3.

Figure 9:
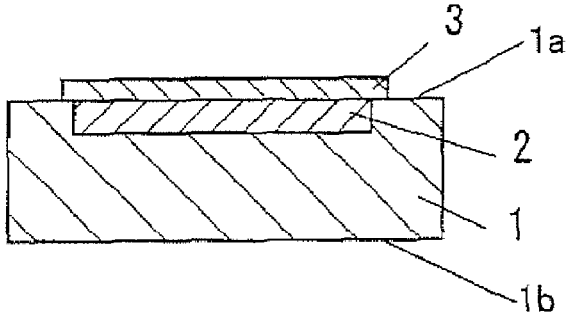
FIG. 9 is sectional view showing another example of a constitution of the pressure wave generator in accordance with the second embodiment.

In the latter case, since a projection domain of the thermal insulation layer 2 to the heating conductor 3 fits inward than the outer periphery of the heating conductor 3, the outer peripheral portion of the heating conductor 3 directly contacts with the first surface 1*a* of the semiconductor substrate 1. In this way, when the outer periphery of thermal insulation layer 2 is formed inward than the outer periphery of heating conductor 3, the thickness of the thermal insulation layer 2 in the outer peripheral portion may be formed to become approximately the same as the thickness (above mentioned reference thickness) in the center portion, as show in FIG. 9A (SIC).

In the latter case, the heat conductivity and the volume heat capacity of single crystalline silicon which is a material of the semiconductor substrate 1 correspond to the above-mentioned α out and Cout, and the heat conductivity and the volume heat capacity of porous silicon which is a material of the thermal insulation layer 2 correspond to the α in and Cin. Thus, a magnitude relation of products with the heat conductivity and the volume heat capacity of the materials satisfies the condition of α in×Cin<α out×Cout. In addition, since the boundary of an area, in which the value of α in×Cin varies, is located inward than the outer periphery of the heating conductor 3, it is possible to make the temperature gradient in the outer peripheral portion of the heating conductor 3 gentle. In comparison with the conventional pressure wave generator, thermal stress applying to the heating conductor 3 can be reduced.

Figure 37A:
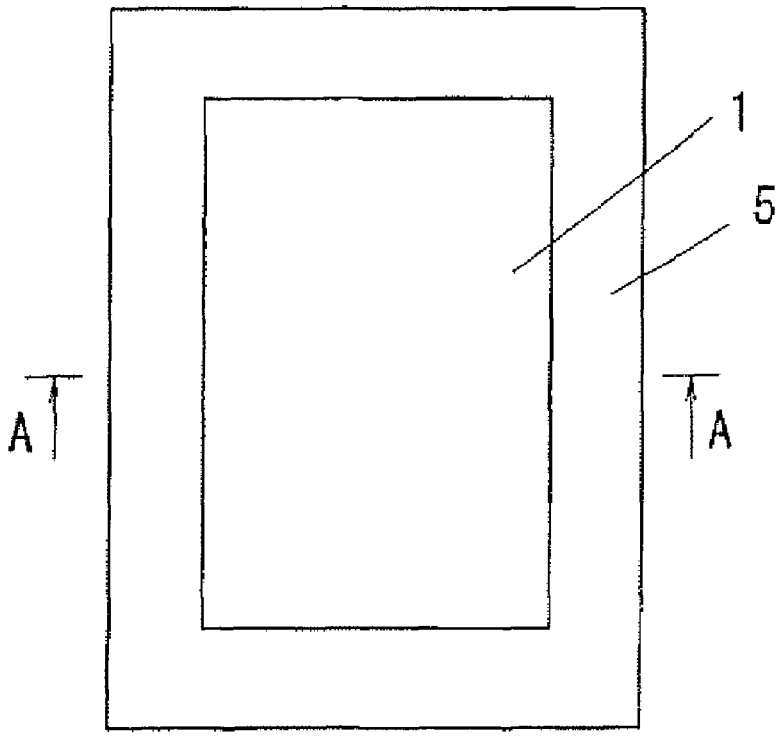
FIG. 37A is a plain view showing a production process of manufacture of the conventional pressure wave generator.
Figure 37B:
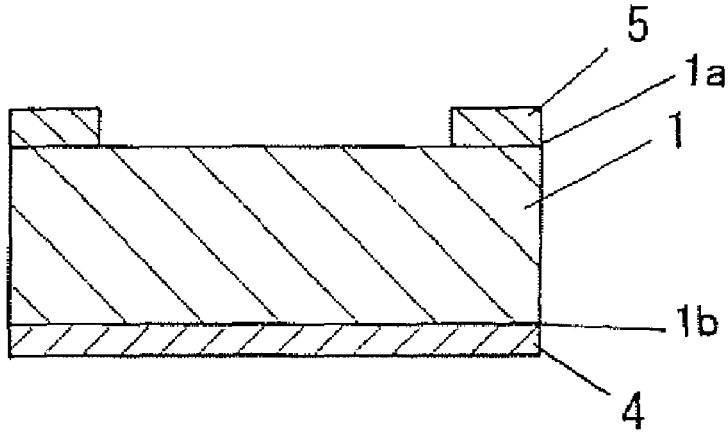
FIG. 37B is an A-A sectional drawing of FIG. 36A.

In addition, even when the energizing electrode 4 is formed on entire of the second surface 1*b* of the semiconductor substrate 1 as shown in FIG. 37B, thermal insulation layer 2 can be formed same as the above. In such a case, a masking layer 5 is formed on the first surface 1*a* of the semiconductor substrate 1 so as to prescribe an area in which thermal insulation layer 2 is to be formed, when thermal insulation layer 2 is formed by the anodization processing.

In the second embodiment, although p-type single crystalline silicon substrate is used for the semiconductor substrate 1, a material of the semiconductor substrate 1 is not limited to the p-type single crystalline silicon substrate, and thereby, polycrystalline or amorphous p-type silicon substrate may be used. In addition, the semiconductor substrate 1 is not limited to the p-type substrate, and it may be n-type substrate or non-dope substrate. The conditions of the anodization processing should be changed appropriately, depending on the kind of the semiconductor substrate 1. Similarly, a porous material constituting the thermal insulation layer 2 is not limited to porous silicon layer. For example, it may be a porous polycrystalline silicon layer formed by anodization of a polycrystalline silicon substrate, or a porous semiconductor layer of a semiconductor material except silicon. In addition, a material of the heating conductor 3 is not limited to aluminum. It is possible to use a metal material (for example, W, Mo, Pt, Ir) having higher heat-resistant than that of aluminum (Al) may be used in comparison with Al. The same goes for other embodiment described below.

Third Embodiment

Subsequently, a third embodiment of the present invention is described. Essential structure of the pressure wave generator of the third embodiment is the same as that of the above mentioned second embodiment, but different at a point of adopting an n-type single crystalline silicon substrate for the semiconductor substrate 1 from the second embodiment. Thus, description and illustration of the configuration of the pressure wave generator is omitted, but only the process of manufacture of the pressure wave generator is described with reference to FIGS. 10A to 10C.

Figure 10A:
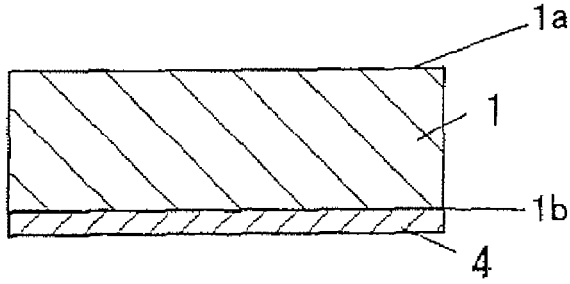
FIGS. 10A to 10C are process drawings showing processes of manufacture of the pressure wave generator in accordance with a third embodiment.

As show in FIG. 10A, an energizing electrode 4 used for anodization processing is formed on an entire surface of a second surface 1*b* in thickness direction of a semiconductor substrate 1 of n-type silicon substrate. As for the energizing electrode 4, it is possible that an electric conductive layer is formed on the second surface 1*b* of the semiconductor substrate 1 with using, for example, by sputtering method or vacuum deposition.

Figure 10B:
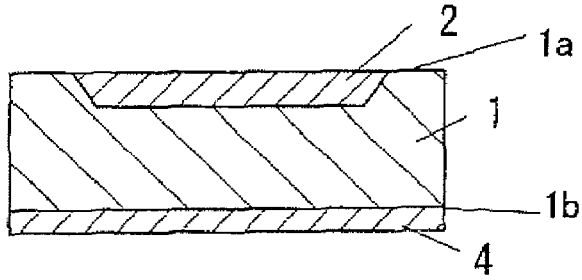
Figure 10C:
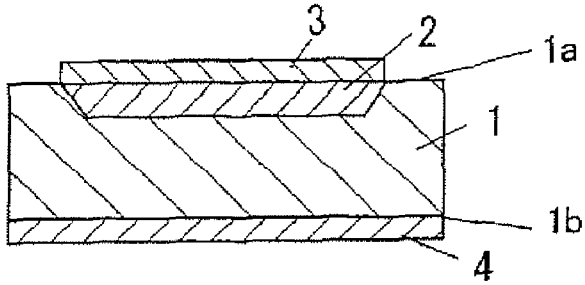
Figure 11A:
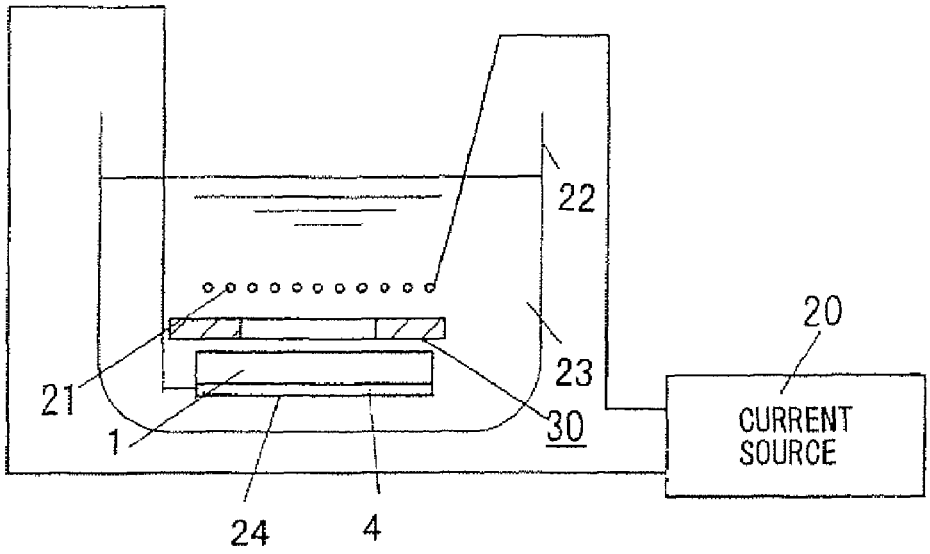
FIG. 11 is a drawing showing a configuration of an anodization apparatus used for process of manufacture of the pressure wave generator in accordance with the third embodiment.

After forming the energizing electrode 4, an end of a lead wire (it is not illustrated) for energization is connected to the energizing electrode 4, and the energizing electrode 4 and the end of the lead wire are coated by sealant having hydrofluoric acid proof so as not touched the electrolyte used for anodization processing Subsequently, the anodization processing is performed with using an anodization apparatus shown in FIG. 11A. The thermal insulation layer 2 of porous silicon layer shown in FIG. 10B is formed on the semiconductor substrate 1. By performing a heating conductor forming processing to the heating conductor forming area 3*a* on the first surface 1*a* of the semiconductor substrate 1 afterwards, a structure having the heating conductor 3 shown in FIG. 10C is obtained.

According to the process of manufacture of the pressure wave generator of the third embodiment, the thermal insulation layer 2 is formed by the anodization processing, as mentioned above. In the anodization processing, an object 24 to be processed having the semiconductor substrate 1 as a main component is dipped into an electrolyte 23 in a processing tank 22, as shown in FIG. 11A. Subsequently, a light shielding plate 30 made of a material having proof for the electrolyte 23 is arranged to face the first surface 1*a* of the semiconductor substrate 1, and a platinum electrode 21 is further arranged to face the first surface 1*a* of the semiconductor substrate 1 and the light shielding plate 30 in the electrolyte 23. Still furthermore, the lead wire connected to the energizing electrode 4 is connected to plus side and the platinum electrode 21 is connected to minus side of a current source 20, respectively. Then, a current with a predetermined current density (for example, 20 mA/cm$^2$) is flown in a predetermined term (for example, eight minutes) between the energizing electrode 4 and the platinum electrode 2 from the current source 20, while using the energizing electrode 4 as an anode and the platinum electrode 21 as a cathode under irradiation of light by a light source such as a tungsten lamp (not illustrated).

By such anodization processing, the thermal insulation layer 2 that thickness is approximately uniformity (for example, 10 μm) except the outer peripheral portion is formed by the first surface 1*a* side of the semiconductor substrate 1. The object 24 to be processed is taken out from the processing tank 22, the sealant is removed from the object 24 to be processed, and the lead wire connected to the energizing electrode 4 is taken off, afterwards.

Besides, the conditions in the anodization processing are not limited in particular For example, the current density should be set in a range of 1 to 500 mA/cm$^2$, appropriately. In addition, the term for running the current should be set depending on a thickness of the thermal insulation layer 2, appropriately.

As for an electrolyte used in the anodization processing, a mixture of an aqueous solution of hydrogen fluoride of 55 wt % and ethanol by 1:1 is used. As for the sealant, a sealant of the fluoroplastic such as Teflon (registered trade mark) can be used.

Figure 11B:
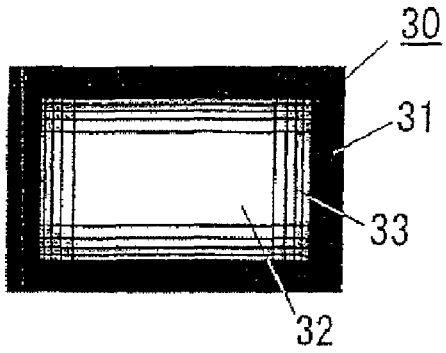

The light shielding plate 30 is formed in a planar shape shown in FIG. 11B of a material (for example, silicon) having proof for the electrolyte 23. Specifically, the light shielding plate 30 is formed in a manner so that an open area ratio of a center portion 32 facing an area in which the thermal insulation layer 2 is formed (thermal insulation layer forming area) on the semiconductor substrate 1 is made to be 100%, an open area ratio of a periphery portion 31 facing an area except the thermal insulation layer 2 is made to be 0%, and an open area ratio of a portion 33 facing the outer peripheral portion of the thermal insulation layer 2 is made gradually smaller from inside towards outside.

Since the process for forming the heating conductor 3 is similar to that of the above mentioned second embodiment, a metal thin film (for example, Aluminum thin film) for the heating conductor 3 is formed by sputtering method on the first surface 1*a* of the semiconductor substrate 1. Photo resist is spread on the metal thin film, and a patterned resist layer for forming the heating conductor 3 (not illustrated) is formed by a photolithography technique afterwards. Then, the resist layer is used as a mask for removing an unnecessary portion of the metal thin film by a dry-etching processing, so that the heating conductor 3 is formed. Finally, the structure shown in FIG. 10C is obtained by removing the resist layer.

According to the process of manufacture of pressure the wave generator of the third embodiment, in a process for forming the thermal insulation layer 2, the light shielding plate 30 is used for reducing the intensity of light irradiated to the outer peripheral portion of the thermal insulation layer forming area on the first surface 1*a* of the semiconductor substrate 1 than that of tight irradiated to the center portion, while the anodization processing is performed. Therefore, velocity of porous in the outer peripheral portion of the thermal insulation layer forming area on the first surface 1*a* of the semiconductor substrate 1 becomes slower than velocity of porous in the center portion. Consequently, the inclined portions 2*a* are formed in a manner so that outside comes to have a small thickness gradually in the outer peripheral portion of the thermal insulation layer 2 formed by the first surface 1*a* side of the semiconductor substrate 1, as shown in FIG. 2B. In comparison with the conventional pressure wave generator, thermal stress applied to the heating conductor 3 can be reduced, and fracture of the heating conductor 3 due to thermal stress rarely occurs.

Fourth Embodiment

Figure 12:
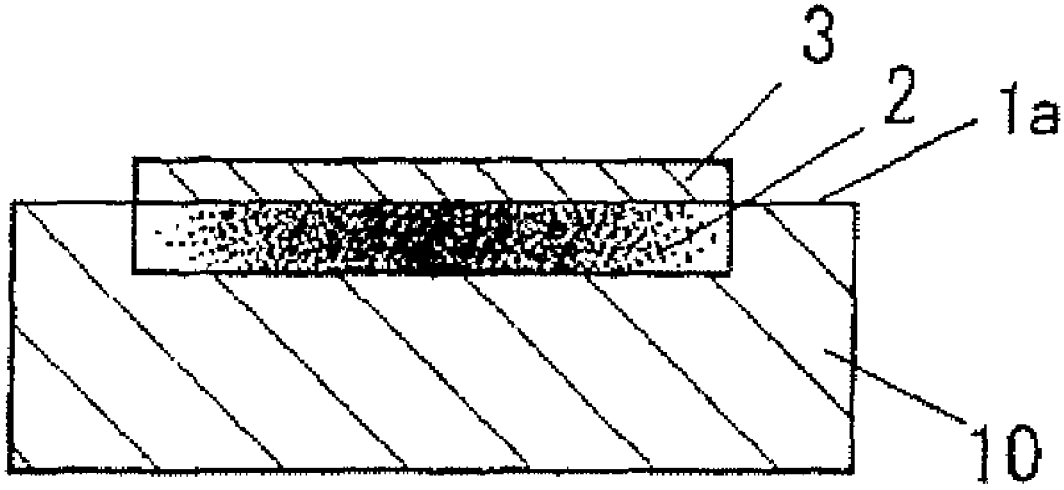
FIG. 12 is sectional view showing a configuration of a pressure wave generator in accordance with a fourth embodiment of the present invention.

Subsequently, a fourth embodiment of the present invention is described. Essential structure of the pressure wave generator of the fourth embodiment is approximately the same as the second embodiment. However, it is different that a thickness of the thermal insulation layer 2 in the outer peripheral portion thereof is made substantially equal to a thickness (above reference thickness) in the center portion, and porosity of porous silicon layer constituting the thermal insulation layer 2 rises gradually towards the boundary portion from the center portion, as shown in FIG. 12. Besides, the same elements as those in the first embodiment are designated by the same reference numerals, and descriptions of them are omitted.

In the pressure wave generator of the fourth embodiment, the outer periphery of the heating conductor 3 almost coincides with the outer periphery of thermal insulation layer 2 (that is, the boundary of the area, in which the value of $\alpha$ in×Cin varies is coincided with the outer periphery of the heating conductor 3), and the thickness of the thermal insulation layer 2 is made substantially uniform in the outer peripheral portion and in the center portion. However, a product of mean heat conductivity with mean volume heat capacity in the outer peripheral portion of the thermal insulation layer 2 is made larger than a product of heat conductivity with mean volume heat capacity in the center portion. In other words, physicality of a material for the thermal insulation layer 2 is made heterogeneous, so that porosity per unit volume in the outer peripheral portion of the thermal insulation layer 2 becomes smaller than porosity per unit volume in the center portion.

In the pressure wave generator of the fourth embodiment, it is possible to increase heat quantity radiated along the thickness direction of the semiconductor substrate 1 from the outer peripheral portion of the heating conductor 3, so that the thermal stress applied to the heating conductor 3 can be reduced. On the other hand, it is possible to restrain the degradation of amplitude of the pressure wave, without increasing heat quantity radiated from the outer peripheral portion of the heating conductor 3 to the semiconductor substrate 1.

Figure 13A:
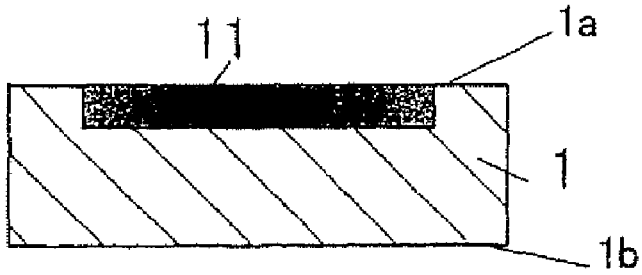
FIGS. 13A to 13E are process drawings showing processes of manufacture of the pressure wave generator in accordance with the fourth embodiment.

Subsequently, process of manufacture of the pressure wave generator of the fourth embodiment is described with reference to FIGS. 13A to 13E and 14. As shown in FIG. 13A, an impurity doped region 11 of predetermined thickness (for example, 2 μm) is formed on an area on the first surface 1*a* of the semiconductor substrate 1 of p-type silicon substrate, in which the thermal insulation layer 2 is formed, (thermal insulation layer forming area) by the semiconductor doping attention that used ion implantation or thermal diffusion method. The impurity doped region 11 is formed to have a distribution of impurity density that specific resistance in the outer peripheral portion becomes smaller than specific resistance in center portion (in the fourth embodiment, the specific resistance becomes gradually smaller from the center portion toward the outer peripheral portion).

Lengths of the longer side and the shorter side in a plane size of the heating conductor 3 are respectively set to be 12 mm and 10 mm, and a value of the specific resistance in the center portion of the impurity doped region 11 is set to be about 30 Ω·cm, and a value of the specific resistance in the outer peripheral portion is set to be about 2 Ω·cm. In addition, the impurity is doped in a manner so that the value of the specific resistance is gradually varied between the center portion and the outer peripheral portion. Besides, these numeric values are examples, and it is not limited in particular.

Figure 13B:
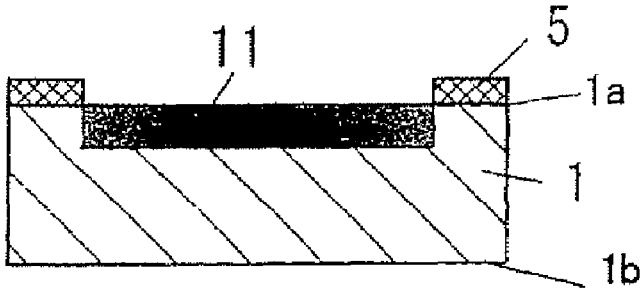

Subsequently, a silicon nitride film used for masking formation in the anodization processing is formed on entire surface of the first surface 1*a* of the semiconductor substrate 1 by plasma CVD method, and an open aperture is formed at a portion overlapping the thermal insulation layer forming area among silicon nitride film with utilizing the photolithography technique and the etching technique. Consequently, as shown in FIG. 13B, a masking layer 5 of remaining silicon nitride film is formed on the first surface 1*a* of the semiconductor substrate 1.

Figure 13C:
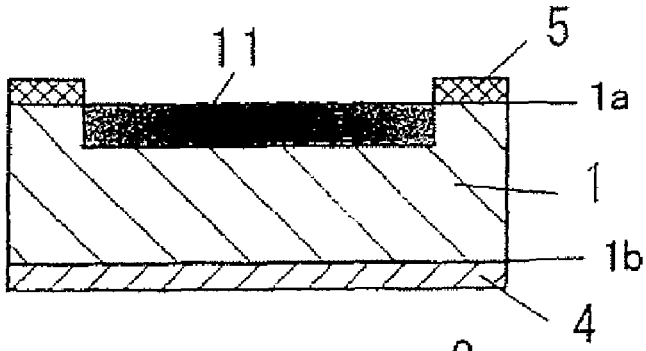

Subsequently, as shown in FIG. 13C, an energizing electrode 4 used in the anodization processing is formed on entire surface of the second surface 1*b* of the semiconductor substrate 1 of p-type silicon substrate. Besides, an electric conductive layer is formed on the second side 1*b* of the semiconductor substrate 1 by sputtering method or vacuum deposition method, as the energizing electrode 4.

Figure 13D:
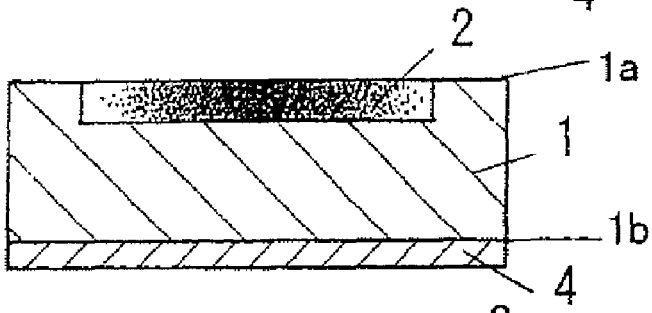
Figure 13E:
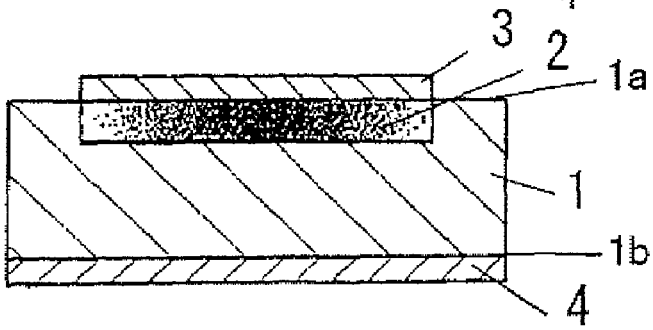

After forming the energizing electrode 4, an end of a lead wire (it is not illustrated) for energization is connected to the energizing electrode 4, and the energizing electrode 4 and the end of the lead wire are coated by sealant having hydrofluoric acid proof so as not touched the electrolyte used for anodization processing. Subsequently, the anodization processing is performed with using an anodization apparatus shown in FIG. 7, so that the thermal insulation layer 2 of porous silicon layer where the porosity in the center portion is different from that in the outer peripheral portion is obtained. Subsequently, a structure shown in FIG. 13D is obtained by removing the mask layer 5. After that, a process for forming the heating conductor is performed on the heating conductor forming area 3*a* on the first surface 1*a* of the semiconductor substrate 1, so that the structure having the heating conductor 3 as shown FIG. 13E is obtained.

The anodization processing using the anodization apparatus shown for FIG. 7 is essentially similar to the case of the second embodiment. The thermal insulation layer 2 having a predetermined thickness (for example, 2.5 μm) is formed by the first surface 1*a* side of the semiconductor substrate 1 by supplying electric current with a predetermined current density (for example, 20 mA/cm$^2$) from a current source 20 between the energizing electrode 4 and the platinum electrode 21 in a predetermined term (for example, 2 minutes), while the energizing electrode 4 as an anode and the platinum electrode 21 as a cathode. As for the porosity of in the center portion of thermal insulation layer 2 was about 60% and the porosity in the outer peripheral portion was about 0%.

Besides, the conditions in the anodization processing are not limited in particular. For example, the current density should be set in a range of 1 to 500 mA/cm$^2$, appropriately. In addition, the term for running the current should be set depending on a thickness of the thermal insulation layer 2, appropriately.

As for an electrolyte used in the anodization processing, a mixture of an aqueous solution of hydrogen fluoride of 55 wt % and ethanol by 1:1 is used. As for the sealant, a sealant of the fluoroplastic such as Teflon (registered trade mark) can be used.

Since the process for forming the heating conductor 3 is similar to that of the second embodiment, a metal thin film (for example, Aluminum thin film) for the heating conductor 3 is formed by sputtering method on the first surface 1*a* of the semiconductor substrate 1. Photo resist is spread on the metal thin film, and a patterned resist layer for forming the heating conductor 3 (not illustrated) is formed by a photolithography technique afterwards. Then, the resist layer is used as a mask for removing an unnecessary portion of the metal thin film by a dry-etching processing, so that the heating conductor 3 is formed. Finally, the structure shown in FIG. 13E is provided by removing the resist layer.

According to the process of manufacture of pressure the wave generator of the third embodiment, the porosity of the thermal insulation layer 2 in the outer peripheral portion can be reduced than that in the center portion, while the thickness of the thermal insulation layer 2 formed on the semiconductor substrate 1 can be made substantially uniform. In other words, a product of mean thermal conduction with mean volume heat capacity in the outer peripheral portion of the thermal insulation layer 2 becomes larger than a product of mean heat conductivity with mean volume heat capacity in the center portion. In comparison with the conventional pressure wave generator, thermal stress applied to the heating conductor 3 can be reduced, so that fracture due to the heating conductor 3 rarely occurs.

In addition, when the thermal insulation layer 2 is formed in a manner so that coefficient of thermal expansion of the thermal insulation layer 2 in the outer periphery thereof agrees with coefficient of thermal expansion of the semiconductor substrate 1 at the boundary between them, non-contiguous point of coefficient of thermal expansion disappears In brief, in an area in which the value of $\alpha$ in×Cin varies, when at least one of the heat conductivity and the volume heat capacity of the material constituting the thermal insulation layer 2 becomes larger than that in the center toward the outer periphery, and material compositions in both sides at a portion of $\alpha$ in×Cin=$\alpha$ out×Cout agree with each other, it is possible to disappear the non-contiguous point of coefficient of thermal expansion at the portion of $\alpha$ in×Cin=$\alpha$ out×Cout. As a result, crack rarely occurs in the thermal insulation layer 2 due to stress caused by difference between coefficients of thermal expansion in the outer peripheral portion of the thermal insulation layer 2 and the semiconductor substrate 1.

Figure 14:
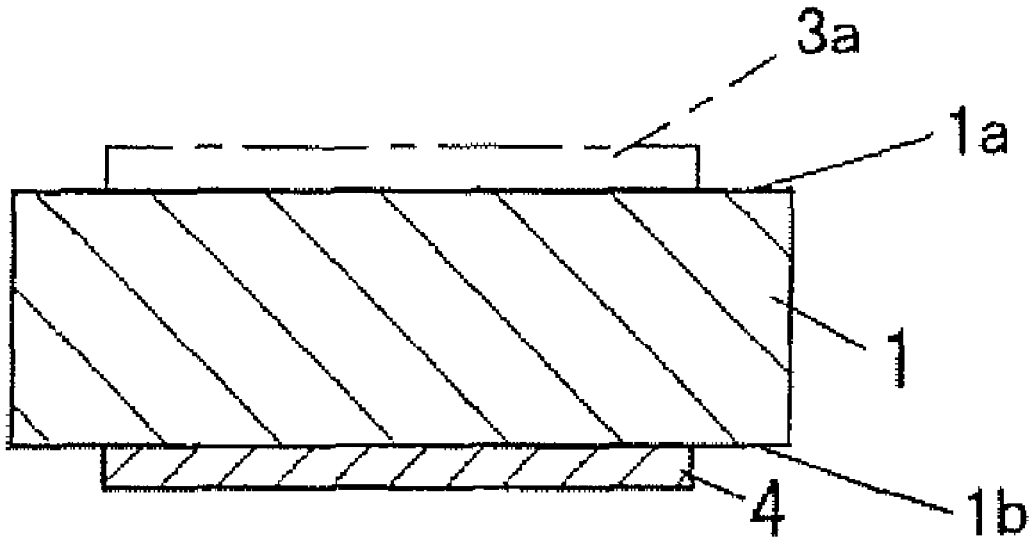
FIG. 14 is a process drawing showing another process of manufacture of the pressure wave generator in accordance with the fourth embodiment.

In addition, as shown FIG. 14, when a planar shape of the energizing electrode 4 is formed as a shape aligning with the heating conductor formation domain 3*a* on the first surface 1*a* of the semiconductor substrate 1, it is possible to form the thermal insulation layer 2 of porous silicon layer by making only the impurity doped region 11 porous with no masking layer 5 on the first surface 1*a* of the semiconductor substrate 1.

Fifth Embodiment

Figure 15A:
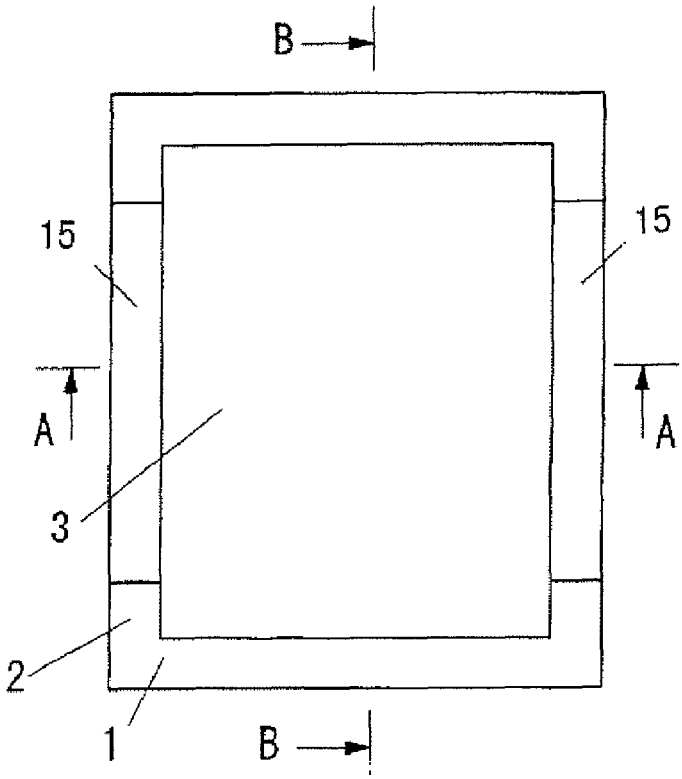
FIG. 15A is a plain view showing a configuration of a pressure wave generator in accordance with a fifth embodiment of the present invention.
Figure 15B:
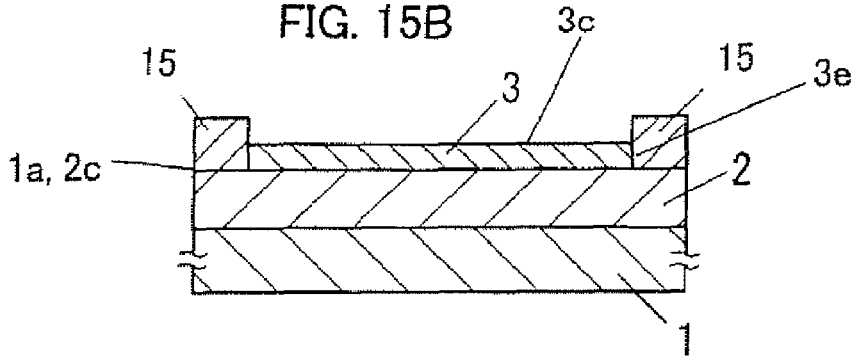
FIG. 15B is as A-A sectional view in FIG. 15A.

Subsequently, a fifth embodiment of the present invention is described. As shown in FIGS. 15A and 15B, a pressure wave generator of the fifth embodiment comprises a semiconductor substrate 1 of p-type single crystalline silicon substrate, a thermal insulation layer 2 of porous silicon layer formed by a first surface 1*a* of the semiconductor substrate 1, and a heating conductor 3 of a thin film (for example, metal thin film such as aluminum thin film) formed on the thermal insulation layer 2. Besides, the thermal insulation layer 2 is not limited to porous silicon layer, and it may be constituted with $SiO_2$ film or $Si_3N_4$ film.

In comparison with the pressure wave generators in accordance with the first to fourth embodiments, in the pressure wave generator of the fifth embodiment the thermal insulation layer 2 is formed by entire of the first surface 1*a* of the semiconductor substrate 1, and temperature gradient mitigation portions 15 are formed in a manner to contact with end surfaces 3*e* of both outer peripheral portions of the longer side of the heating conductor 3 on the first surface 1*a* of the semiconductor substrate 1 (surface 2*c* of the thermal insulation layer 2).

The temperature gradient mitigation portion 15 is a high thermal conductive layer formed of a material having heat conductivity higher than that of the thermal insulation layer 2. As for a material of the temperature gradient mitigation portion 15, it is possible that an inorganic material having electrical insulation characteristics higher than those of the heating conductor 3, and having heat conductance higher than that of the thermal insulation layer 2, such as a material of AlN system or SiC system. Especially, the material of AlN system or SiC system is desirable because coefficient of thermal expansion thereof is smaller than that of Si. The temperature gradient mitigation portion 15 of such an inorganic material can be formed on a predetermined area by sputtering method with using a masking. In addition, the temperature gradient mitigation portions 15 are formed in a manner to contact with side edges of the longer sides among the outer periphery of the heating conductor 3 formed on the thermal insulation layer 2, but not to contact with a surface 3*c* of the heating conductor 3 (refer to FIG. 15B).

According to the pressure wave generator of the fifth embodiment, a part of the heat generated in the vicinity of the longer side of the heating conductor 3 is transmitted to the temperature gradient mitigation portion 15, so that the temperature gradient of the vicinity of the longer side of the heating conductor 3, that is, the temperature gradient in the vicinity of the thermal insulation layer 2 can be made smooth. Therefore, in comparison with the conventional pressure wave generator, thermal stress applied to the heating conductor 3 can be reduced, and fracture of the heating conductor 3 due to thermal stress rarely occurs. As a result, longevity life of the pressure wave generator can be achieved. Furthermore, while the heating conductor 3 is energized, it is possible to increase electric power than in the conventional pressure wave generator, so that amplitude of pressure wave generated by the pressure wave generator of the fourth embodiment can be magnified.

In addition, since the temperature gradient mitigation portion 15 is formed so as to contact with the end surface 3*e* of the longer side of the heating conductor 3 but not to contact with the surface 3*c* in the vicinity of the outer peripheral portion, the temperature gradient can be made smooth while reducing temperature degradation in the vicinity of the outer peripheral portion of heating conductor 3. Furthermore, when the above-mentioned inorganic material is used as a material of the temperature gradient mitigation portion 15, it is possible to increase heat resistance of the temperature gradient mitigation portion 15, in comparison with a case of using organic material as the temperature gradient mitigation portion 15. Still furthermore, in a direction of current flow in the heating conductor 3, a resistance of the temperature gradient mitigation portion 15 is much larger than a resistance of the heating conductor 3 (too larger to ignore current flowing to the temperature gradient mitigation portion 15), so that it is possible to reduce power loss due to current flow to the temperature gradient mitigation portion 15.

Sixth Embodiment

Figure 16:
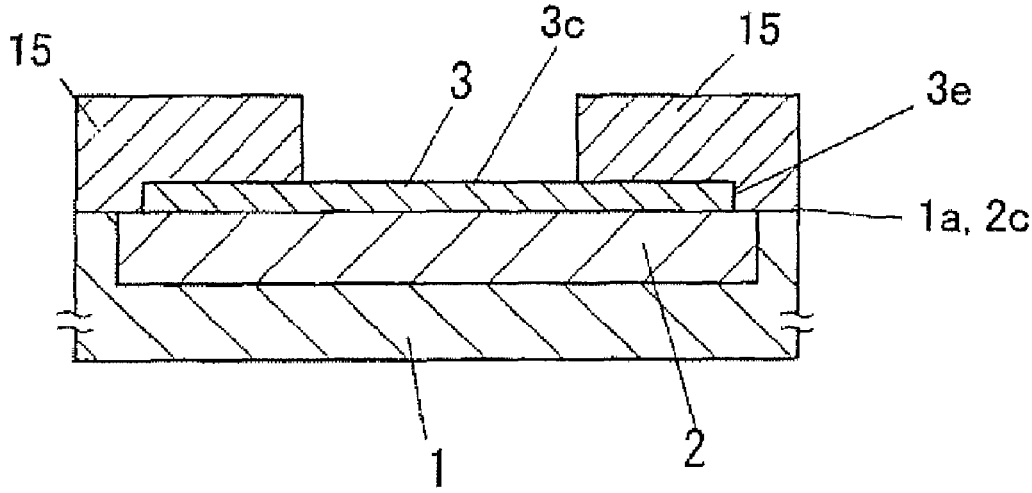
FIG. 16 is a sectional view showing a configuration of a pressure wave generator in accordance with a sixth embodiment of the present invention.

Subsequently, a sixth embodiment of the present invention is described. As shown in FIG. 16, a thermal insulation layer 2 is formed on not entire surface of a semiconductor substrate 1 but in a predetermined area, in the pressure wave generator of the sixth embodiment. In addition, temperature gradient mitigation portions 15 are formed to contact with a surface 2*c* of the thermal insulation layer 2, end surfaces 3*e* of outer peripheral portion and a surface 3*c* in the vicinity of the outer peripheral portion of a heating conductor 3, as well as the first surface 1*a* of the semiconductor substrate 1.

In the pressure wave generator of the sixth embodiment, the temperature gradient mitigation portion 15 contacts with the surface 3*c* as well as the end surfaces 3*e* in the outer peripheral portion of the heating conductor 3. In comparison with the pressure wave generator of the fifth embodiment, a structure thereof becomes a little complex, but the temperature gradient in the vicinity of the outer peripheral portion of the heating conductor 3 can be made much smoother. In addition, a part of the heat generated in the vicinity of the outer periphery of the heating conductor 3 is transmitted to the semiconductor substrate 1 through the temperature gradient mitigation portion 15, so that the heat generated in the vicinity of the outer periphery of the heating conductor 3 can radiated effectively, in comparison with a case that the temperature gradient mitigation portion 15 does not contact with the semiconductor substrate 1.

In the pressure wave generator of the sixth embodiment, the thermal insulation layer 2 is formed in the predetermined area in the first surface 1*a* side of the semiconductor substrate 1. It, however, is possible that the thermal insulation layer 2 can be formed along the entire surface of the first surface 1*a* of the semiconductor substrate 1, like the fifth embodiment.

Seventh Embodiment

Figure 17:
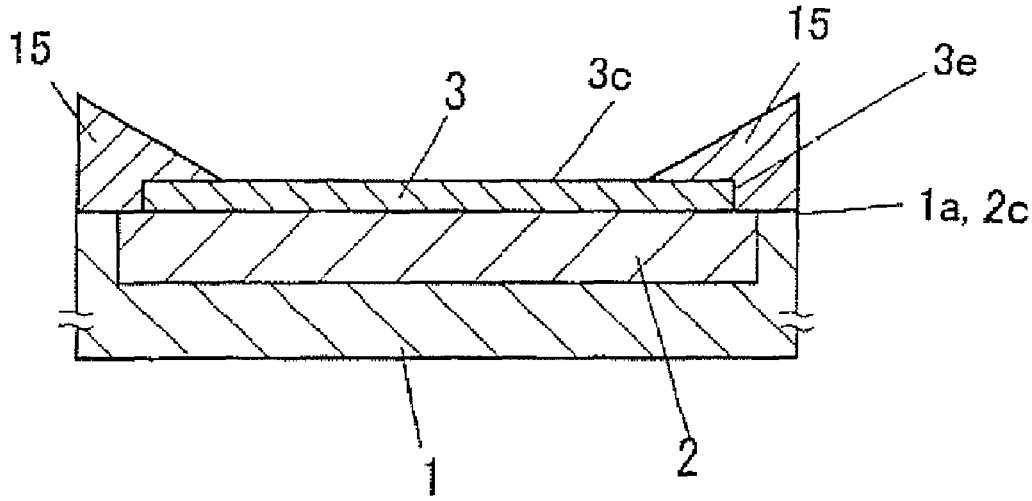
FIG. 17 is a sectional view showing a configuration of a pressure wave generator in accordance with a seventh embodiment of the present invention.

Subsequently, a seventh embodiment of the present invention is described. In the pressure wave generator of the seventh embodiment, as shown in FIG. 17, thickness of the temperature gradient mitigation portion 15 in thickness direction of a semiconductor substrate 1 is made thinner from outer periphery of the semiconductor substrate 1 in width direction to inward of a heating conductor 3, in comparison with the pressure wave generator of the sixth embodiment. Such a temperature gradient mitigation portion 15 can be formed by sputtering method with providing a space between the semiconductor substrate 1 and a masking.

In comparison with the pressure wave generator of the sixth embodiment, a configuration of temperature gradient mitigation portion 15 is complicated in the pressure wave generator of the seventh embodiment, and there is a fear that yield at the time of manufacturing may fall, but the temperature gradient of the outer peripheral portion of the heating conductor 3 can be made much smoother. It, however, is possible that the thermal insulation layer 2 can be formed along the entire surface of the first surface 1*a* of the semiconductor substrate 1, like the fifth embodiment.

Eighth Embodiment

Figure 18:
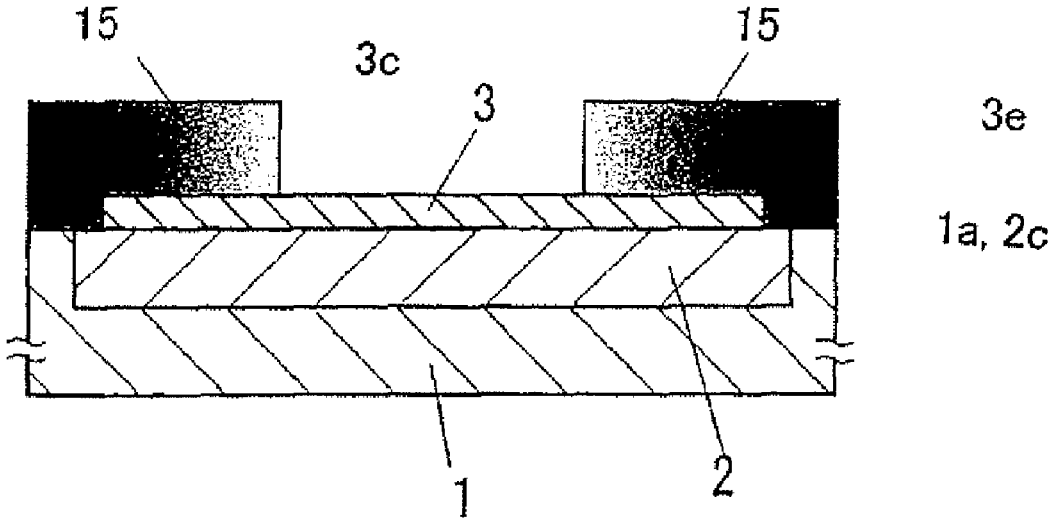
FIG. 18 is a sectional view showing a configuration of a pressure wave generator in accordance with an eighth embodiment of the present invention.

Subsequently, an eighth embodiment of the present invention is described. In the pressure wave generator of the eighth embodiment, as shown in FIG. 18, physicality of a temperature gradient mitigation portions 15 are made inhomogeneous. In width direction of a semiconductor substrate 1, each temperature gradient mitigation portion 15 is formed in a manner to have a distribution of heat conductivity that a value the heat conductivity gradually increases from inward of a heating conductor 3 toward the outer peripheral portion. Other configurations are substantially the same as those of the fifth above embodiment. The temperature gradient mitigation portion 15 having such a distribution of heat conductivity can be realized by making a ratio of composition of, for example, AlN or SiC slant in a high thermal conductance layer of AlN or SiC.

Although manufacturing process of the temperature gradient mitigation portion 15 becomes complicated in the pressure wave generator of the eighth embodiment, in comparison with the pressure wave generator of the above mentioned sixth embodiment, but temperature gradient of the outer peripheral portion of the heating conductor 3 can be made much smoother. In addition, it is possible that the thermal insulation layer 2 can be formed along the entire surface of the first surface 1*a* of the semiconductor substrate 1, like the fifth embodiment.

Ninth Embodiment

Figure 19:
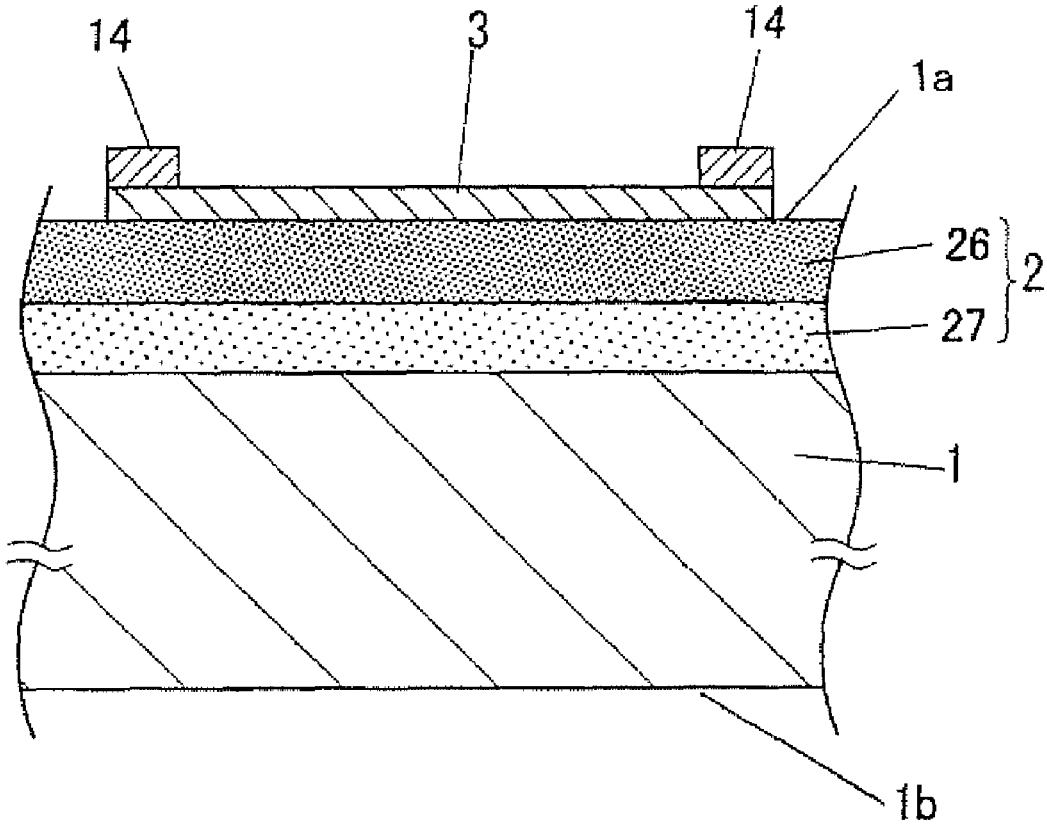
FIG. 19 is a sectional drawing showing a configuration of a pressure wave generator in accordance with a ninth embodiment of the present invention.

Subsequently, a ninth embodiment of the present invention is described. As shown in FIG. 19, the pressure wave generator of the ninth embodiment comprises a semiconductor substrate 1 of p-type single crystalline silicon substrate, a thermal insulation layer 2 of porous layer formed by a first surface 1*a* side in thickness direction of the semiconductor substrate 1, a heating conductor 3 of a thin film (for example, a metal thin film such as aluminum thin film) formed on thermal insulation layer 2, and a pair of pads 14 formed on endpoint portions of the heating conductor 3. The pads 14 are used for supplying an electric current to the heating conductor 3.

In the ninth embodiment, the thermal insulation layer 2 is formed as double layers of a high porosity layer 21 and a low porosity layer 22. The high porosity layer 21 having higher porosity is made of, for example, porous silicon layer having porosity of 70%, and located at a position near to the heating conductor 3. The low porosity layer 22 is made of, for example, porous silicon layer having porosity of 40%, and located at a position near to the semiconductor substrate 1. These porous layers can be formed by anodizing a part of a p-type silicon substrate as the semiconductor substrate 1 in electrolyte. The higher the porosity of the porous silicon layer becomes, the smaller the heat conductivity and volume heat capacity becomes, so that it is possible to make the heat conductivity of the porous silicon layer much smaller than that of the single crystalline silicon, by setting the porosity of the porous silicon layer appropriately.

In the pressure wave generator of the ninth embodiment, a thickness of the semiconductor substrate 1 was set to be 525 μm, a thickness of the high porosity layer 21 of the thermal insulation layer 2 was set to be 5 μm, a thickness of the low porosity layer 22 of the thermal insulation layer 2 was set to be 5 μm, and a thickness of the heating conductor 3 was set to be 50 nm. Besides, these numerical values of the thicknesses are examples, and it is not limited in particular. In addition, it is preferable that a value of the thickness of the high porosity layer 21 is made equal to re larger than a thermal diffusion length L. As an employment example of the pressure wave generator of the ninth embodiment, it is assumed to generate ultrasonic waves of 40 kHz as pressure waves, and a frequency of a waveform of electric input to the heating conductor 3 was set to be 20 kHz. Furthermore, it is assumed that the thermal insulation layer 2 was a porous silicon layer having porosity of 60%, the heat conductivity was 1 W/(m·k), the volume heat capacity was $0.7\times10^6$ J/($m^3$·k), and a frequency f was 40 kHz. The thickness of the high porosity layer 21 was set depending on the thermal diffusion length L=3.37 μm: which was calculated from the above-mentioned formula (2).

Subsequently, process of manufacture of the pressure wave generator of the ninth embodiment is described. At first, an energizing electrode (not illustrated) used in anodization processing is formed on a second surface 1*b* of semiconductor substrate 1, similar to the process of manufacture of the pressure wave generator explained in the second embodiment. Afterwards, a portion in which the high porosity layer 21 is to be formed located by the first surface 1*a* of the semiconductor substrate 1 and another portion in which the low porosity layer 22 is to be formed are respectively made porous by the anodization processing, so that the thermal insulation layer 2 constituted by the high porosity layer 21 and the low porosity layer 22 is formed.

Figure 20:
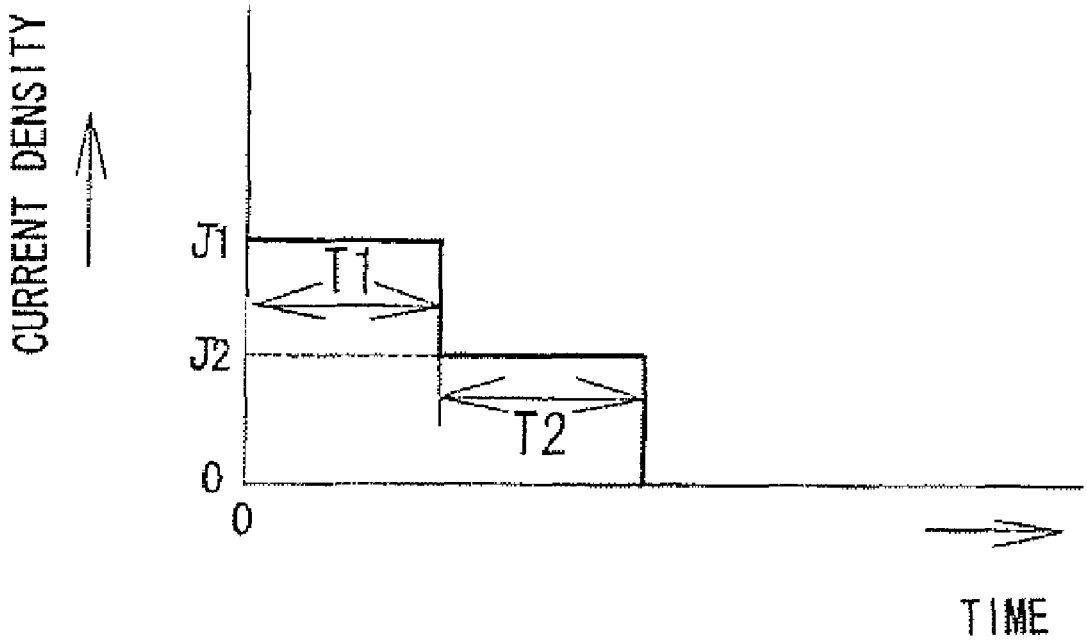
FIG. 20 is a graph showing an example of current density pattern in anodization processing of manufacture of the pressure wave generator in accordance with the ninth embodiment.

In the anodization processing, an electrolyte of a mixture of an aqueous solution of hydrogen fluoride of 55 wt % and ethanol by 1:1 is used. An object to be processed having the semiconductor substrate 1 as a main component is dipped into the electrolyte in a processing tank. With using an energizing electrode as an anode and a platinum electrode arranged to face the first surface 1*a* of the semiconductor substrate 1 as a cathode, a current with a predetermined current density is flown between the energizing electrode and the platinum electrode from a current source. As shown in FIG. 20, an anodization processing is performed for forming the high porosity layer 21 with a first current density J1 (for example, 100 mA/$cm^2$) in a first predetermined term T1 (for example, 2 minutes), and another anodization processing is performed for forming the low porosity layer 22 with a second current density J2 (for example, 10 mA/$cm^2$) in a second predetermined term T2 (for example, 15 minutes). In this way, the high porosity layer 21 and the low porosity layer 22 can be formed continuously.

After completing the anodization processing, the object to be processed is taken out from the electrolyte, cleaning and drying are sequentially performed. Subsequently, the heating conductor 3 and the pads 14 are formed, so that the pressure wave generator shown in FIG. 19 is manufactured. In addition, in dry process, various drying method such as drying by nitrogen gas, drying by spin drier can be adopted appropriately. Furthermore, in the process for forming the heating conductor 3, it is possible to form the heating conductor 3 by vacuum deposition with using a metal masking. Even in the process for forming the pads 14, it is possible to form the pads 14 by vacuum deposition with using a metal masking.

According to the pressure wave generator of the ninth embodiment, the thermal insulation layer 2 is configured by the high porosity layer 21 located by the heating conductor 3 and the low porosity layer 22 located by the semiconductor substrate 1 in thickness direction of the semiconductor substrate 1, and porosity of the low porosity layer 22 located by the semiconductor substrate 1 is made smaller than that of the high porosity layer 21 located by the heating conductor 3. Thus, mechanical strength of in the vicinity of a boundary between thermal insulation layer 2 and the semiconductor substrate 1 can be increased, while restraining reduction of thermal insulation performance in a portion near to the heating conductor 3 in thermal insulation layer 2. Furthermore, since a stress which occurs in a the vicinity of boundary between the thermal insulation layer 2 and the semiconductor substrate 1 in thermal insulation layer 2 can be reduced, it is possible to prevent the occurrence of cracks in the thermal insulation layer 2 and fracture of the heating conductor 3 in manufacturing or driving of the pressure wave generator. Consequently, enhancement of yield of manufacturing and improvement of reliability can be achieved.

Furthermore, in the pressure wave generator of the ninth embodiment, the thermal insulation layer 2 is configured by the high porosity layer 21 located by the heating conductor 3 and the low porosity layer 22 located by the semiconductor substrate 1, thermal insulation performance of the thermal insulation layer 2 can be defined by porosity and thickness of the high porosity layer 21. On the other hand, the mechanical strength in the boundary of the thermal insulation layer 2 and the semiconductor substrate 1 can be designed by porosity and thickness of the low porosity layer 22. Although the structure of the thermal insulation layer 2 becomes double layers, the design of the thermal insulation performance of the thermal insulation layer 2 becomes easier, and forming of the thermal insulation layer 2 becomes relatively easier. Furthermore, when the thickness of the high porosity layer 21 of the thermal insulation layer 2 is set to be a value equal to or larger than the above-mentioned thermal diffusion length L, it is possible to prevent large reduction of amplitude of pressure waves due to heat conduction to the semiconductor substrate 1. In other words, in the pressure wave generator of the ninth embodiment, it is possible to raise the mechanical strength in manufacturing and driving of the thermal insulation layer 2 without reducing the thermal insulation performance, in comparison with a case that the porosity of the thermal insulation layer 2 in thickness direction of the semiconductor substrate 1 is made uniform. Furthermore, heat resistance of the pressure wave generator in the ninth embodiment is increased in comparison with the conventional pressure wave generator, so that it is possible to raise the electric power applied to the heating conductor 3, and amplitude of the pressure waves generated by the pressure wave generator can be boosted.

Tenth Embodiment

Figure 21:
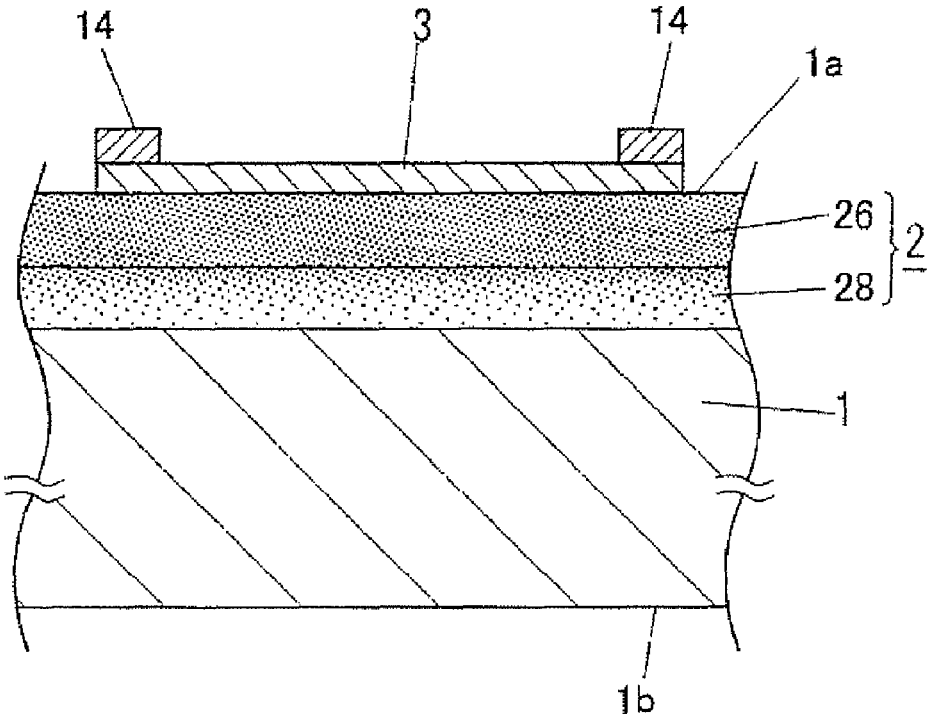
FIG. 21 is a sectional view showing a configuration of a pressure wave generator in accordance with a tenth embodiment of the present invention.

Subsequently, a tenth embodiment of the present invention is described. A pressure wave generator of the tenth embodiment has a configuration substantially the same as that of the pressure wave generator of the above mentioned ninth embodiment, as shown in FIG. 21. A thermal insulation layer 2, however, is constituted by a high porosity layer 21 formed by the heating conductor 3 in thickness direction of the semiconductor substrate 1, and a low porosity inclined layer 23 formed by the semiconductor substrate 1 in which porosity is gradually decreased as approaching to the semiconductor substrate 1. In the low porosity inclined layer 23, depth profile of porosity is designed in a manner so that the porosity of the low porosity inclined layer 23 in a boundary between the high porosity layer 21 and the low porosity inclined layer 23 is continued to the porosity of the high porosity layer 21, and the porosity of the low porosity inclined layer 23 in a boundary between the semiconductor substrate 1 and the low porosity inclined layer 23 becomes substantially zero.

Figure 22:
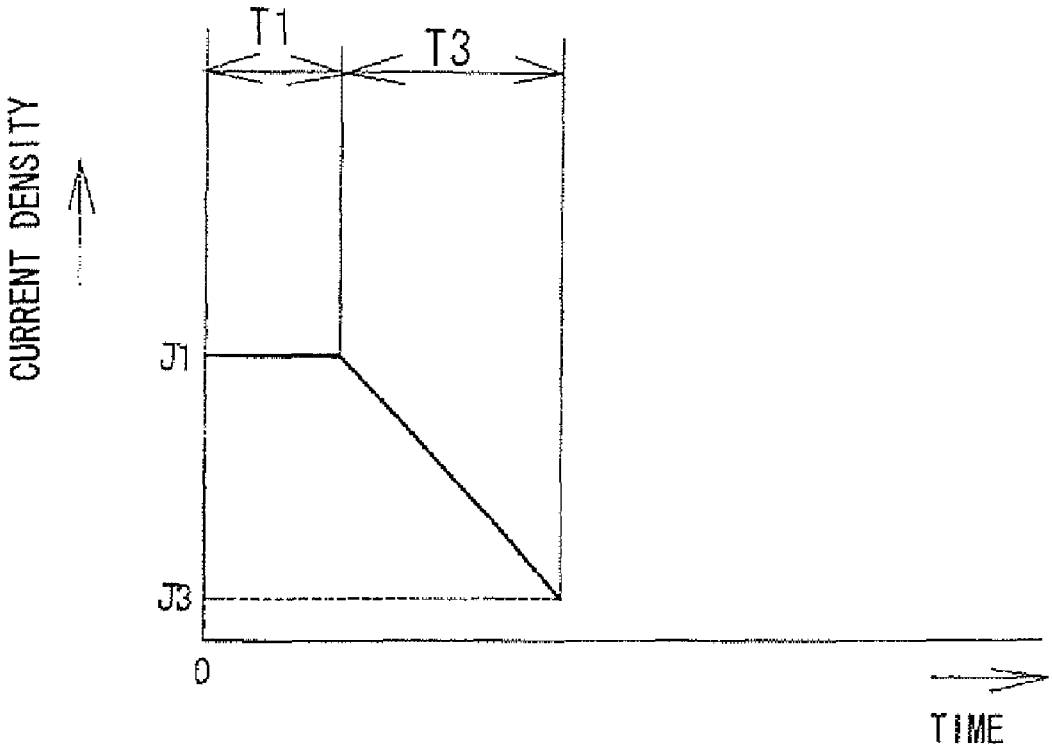
FIG. 22 is a graph showing an example of current density pattern in anodization processing of manufacture of the pressure wave generator in accordance with the tenth embodiment.
Figure 23B:
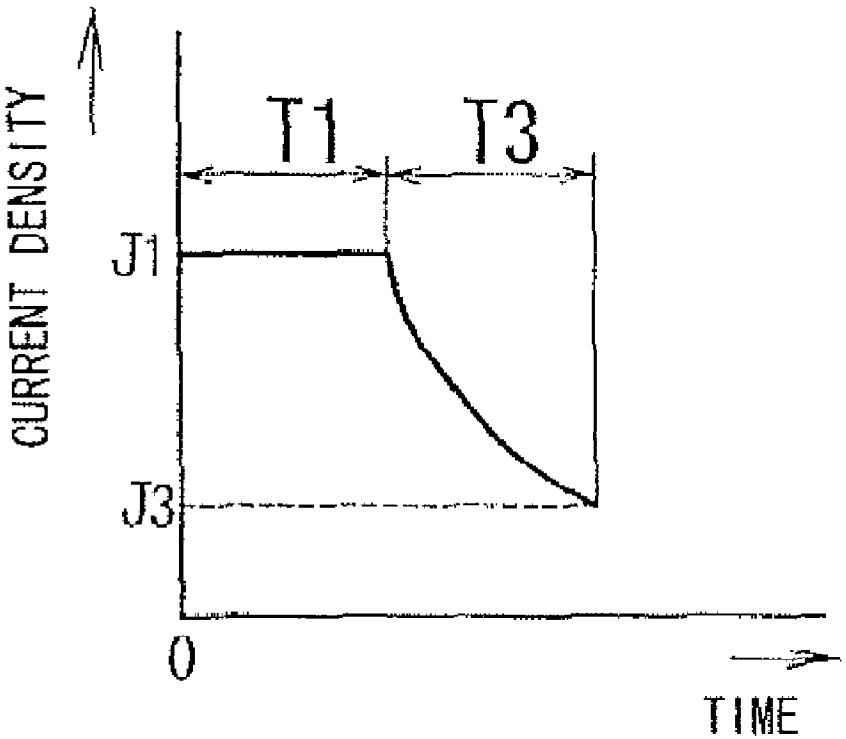
FIG. 23B is a graph showing still another example of current density pattern in anodization processing of manufacture of the pressure wave generator in accordance with the tenth embodiment.
Figure 23A:
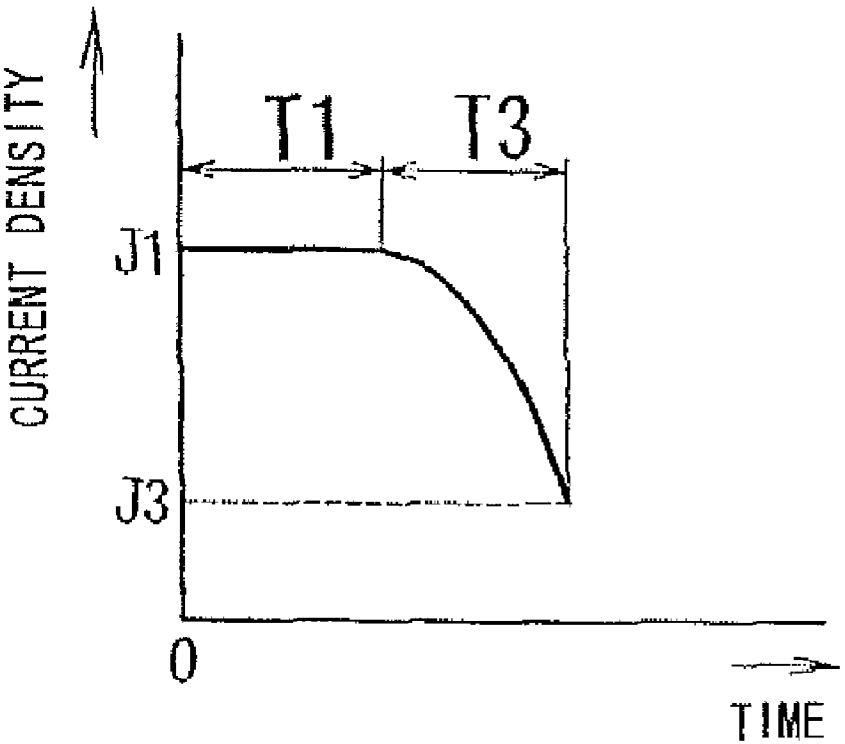
FIG. 23A is a graph showing another example of current density pattern in anodization processing of manufacture of the pressure wave generator in accordance with the tenth embodiment.

Process of manufacture of the pressure wave generator of the tenth embodiment is substantially the same as that of the pressure wave generator of the eighth above embodiment. As shown in FIG. 22, an anodization processing is performed for forming the high porosity layer 21 with a first current density J1 (for example, 100 mA/cm$^2$) in a first predetermined term T1 (for example, 2 minutes). For forming the low porosity inclined layer 23, another anodization processing is performed with a predetermined decreasing pattern of current density suitable for forming the low porosity inclined layer 23 in a second predetermined term T3 (for example, 10 minutes). In the example of decreasing pattern of current density shown in FIG. 22, a monotonic decreasing pattern continuously for reducing the current density from the first current density J1 to a second current density J3 (for example, 0 mA/cm$^2$) while the second predetermined term T3. Besides, the decreasing pattern of current density is not limited to the monotonic decreasing pattern shown in FIG. 22, in which a gradient is constant. For example, it is possible that the gradient of the monotonic decreasing pattern becomes larger with passage of time, as shown FIG. 23A, or the gradient of the monotonic decreasing pattern becomes smaller with passage of time, as shown FIG. 23B.

In the pressure wave generator of the tenth embodiment, the porosity of the low porosity inclined layer 23 located by the semiconductor substrate 1 in thickness direction of the semiconductor substrate 1 is made smaller than the porosity of the high porosity layer 21 located by the heating conductor 3, similar to the pressure wave generator of the ninth embodiment. Thus, mechanical strength in the vicinity of a boundary between thermal insulation layer 2 and the semiconductor substrate 1 can be increased, while restraining reduction of thermal insulation performance in a portion near to the heating conductor 3 in thermal insulation layer 2. Furthermore, since a stress which occurs in the vicinity of the boundary between the thermal insulation layer 2 and the semiconductor substrate 1 in thermal insulation layer 2 can be reduced, it is possible to prevent the occurrence of cracks in the thermal insulation layer 2 and fracture of the heating conductor 3 in manufacturing or driving of the pressure wave generator. Consequently, enhancement of yield of manufacturing and improvement of reliability can be achieved.

In addition, in the pressure wave generator of the tenth embodiment, the porosity continues in the boundary between the high porosity layer 21 and the low porosity inclined layer 23 of the thermal insulation layer 2 in thickness direction of the semiconductor substrate 1. Although the control of current density in the process for forming the thermal insulation layer 2 becomes complex, a stress which occurs in the vicinity of the boundary between the high porosity layer 21 and low porosity inclined layer 23 can be reduced by dispersion, in comparison with the pressure wave generator of the ninth embodiment in which the porosity of thermal insulation layer 2 is varied in a stairs pattern. Thus, mechanical strength of the thermal insulation layer 2 can be raised. Furthermore, since the low porosity inclined layer 23 is formed in a manner so that the porosity thereof in the vicinity of the boundary with the semiconductor substrate 1 becomes substantially zero, it is possible that not only mechanical strength of the thermal insulation layer 2 in the vicinity of the boundary with the semiconductor substrate 1 can be increased, but also stress which occurs in the vicinity can be reduced. Therefore, occurrence of cracks in the thermal insulation layer, fracture of the heating conductor 3 due to crack in the thermal insulation layer 2 and flaking of the thermal insulation layer 2 from the semiconductor substrate 1 in manufacturing and driving of the pressure wave generator can be prevented more surely.

Eleventh Embodiment

Figure 24:
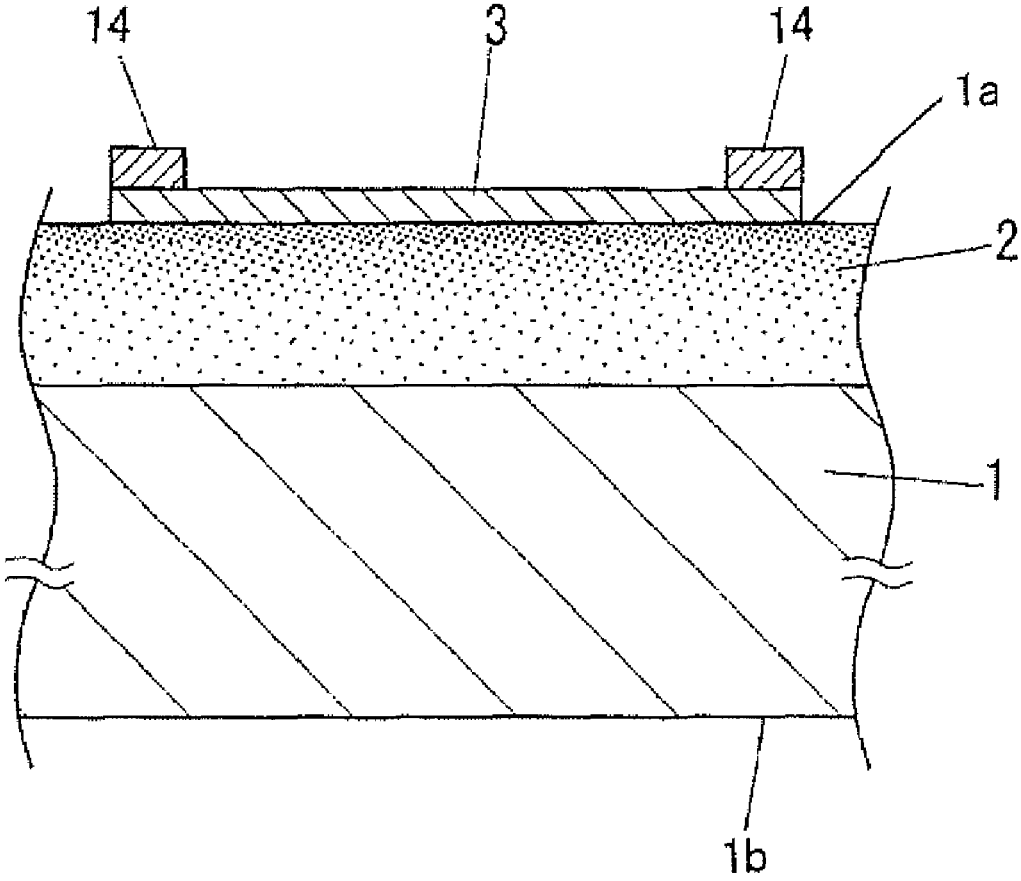
FIG. 24 is a sectional view showing a configuration of a pressure wave generator in accordance with an eleventh embodiment of the present invention.

Subsequently, an eleventh embodiment of the present invention is described. A pressure wave generator of the eleventh embodiment has a structure similar to that of the pressure wave generator of the above mentioned ninth embodiment. The thermal insulation layer 2, however, is formed in a manner so that porosity of the thermal insulation layer 2 becomes gradually smaller as approaching to the semiconductor substrate 1 from the heating conductor 3 in thickness direction of the semiconductor substrate 1, as shown in FIG. 24. In other words, in thickness direction of the semiconductor substrate 1, the porosity of the thermal insulation layer 2 is higher in an area near to the heating conductor 3 with, and is lower in an area near to the semiconductor substrate 1. In addition, as for the thermal insulation layer 2, a depth profile of porosity is set so that the porosity becomes substantially zero in the vicinity of a boundary with the semiconductor substrate 1.

Figure 25:
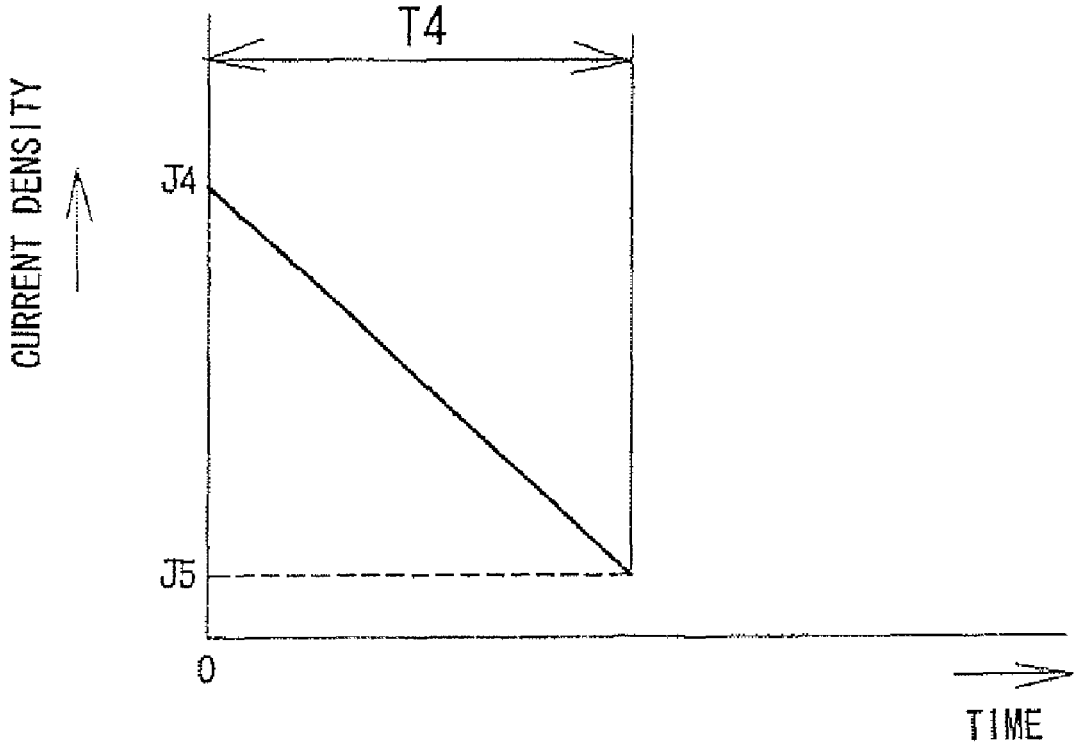
FIG. 25 is a graph showing an example of current density pattern in anodization processing of manufacture of the pressure wave generator in accordance with the eleventh embodiment.
Figure 26B:
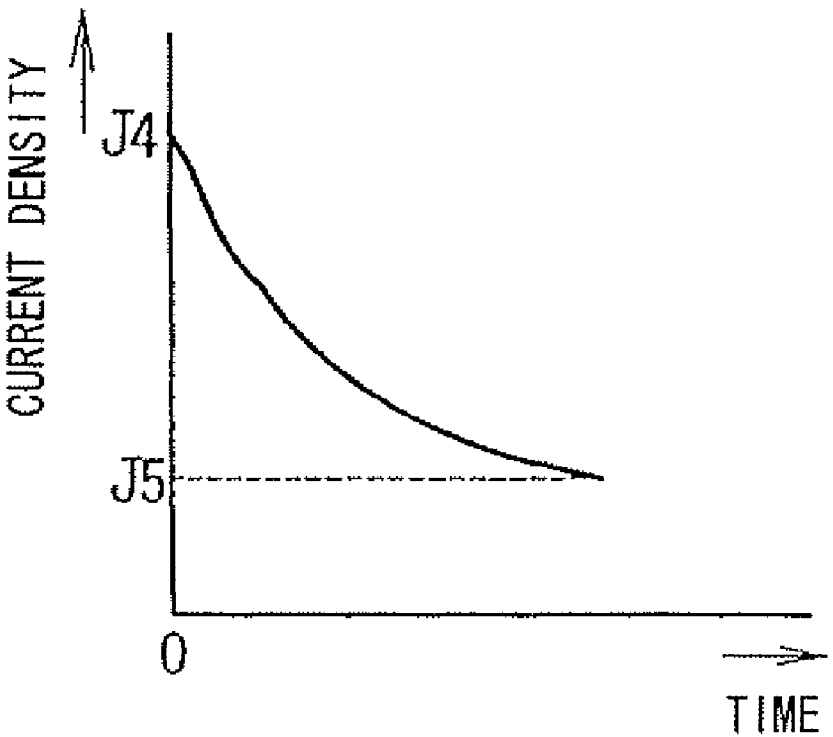
FIG. 26B is a graph showing still another example of current density pattern in anodization processing of manufacture of the pressure wave generator in accordance with the eleventh embodiment.
Figure 26A:
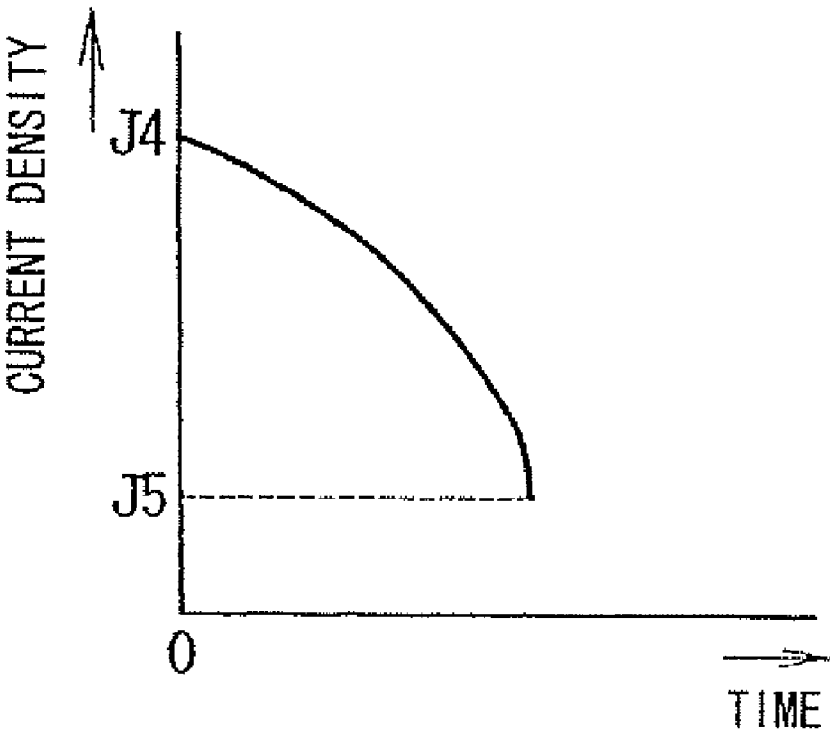
FIG. 26A is a graph showing another example of current density pattern in anodization processing of manufacture of the pressure wave generator in accordance with the eleventh embodiment.

Process of manufacture of the pressure wave generator of the eleventh embodiment is substantially the same as that of the pressure wave generator of the ninth above embodiment. As shown in FIG. 25, an anodization processing is performed with a predetermined decreasing pattern of current density suitable for forming the thermal insulation layer 2 in a predetermined term T4 (for example, 10 minutes). In the example of decreasing pattern of current density shown in FIG. 25, a monotonic decreasing pattern continuously for reducing the current density from the first current density J4 (for example, 100 mA/cm$^2$) to a second current density J5 (for example, 0 mA/cm$^2$) while the predetermined term T4. Besides, the decreasing pattern of current density is not limited to the monotonic decreasing pattern shown in FIG. 25, in which a gradient is constant. For example, it is possible that the gradient of the monotonic decreasing pattern becomes larger with passage of time, as shown FIG. 26A, or the gradient of the monotonic decreasing pattern becomes smaller with passage of time, as shown FIG. 26B.

In the pressure wave generator of the eleventh embodiment, since the porosity of the thermal insulation layer 2 becomes gradually smaller as approaching to the semiconductor substrate 1 from the heating conductor 3 in thickness direction of the semiconductor substrate 1, mechanical strength of the thermal insulation layer 2 can be increased, and a stress which occurs in the vicinity of the boundary between the thermal insulation layer 2 and the semiconductor substrate 1 can be reduced. Furthermore, since the thermal insulation layer 2 is formed in a manner so that the porosity thereof in the vicinity of the boundary with the semiconductor substrate 1 becomes substantially zero, it is possible that not only mechanical strength of the thermal insulation layer 2 in the vicinity of the boundary with the semiconductor substrate 1 can be increased, but also stress which occurs in the vicinity can be reduced. Therefore, occurrence of crack in the thermal insulation layer, fracture of the heating conductor 3 due to crack in the thermal insulation layer 2 and flaking of the thermal insulation layer 2 from the semiconductor substrate 1 in manufacturing and driving of the pressure wave generator can be prevented more surely.

Twelfth Embodiment

Figure 27:
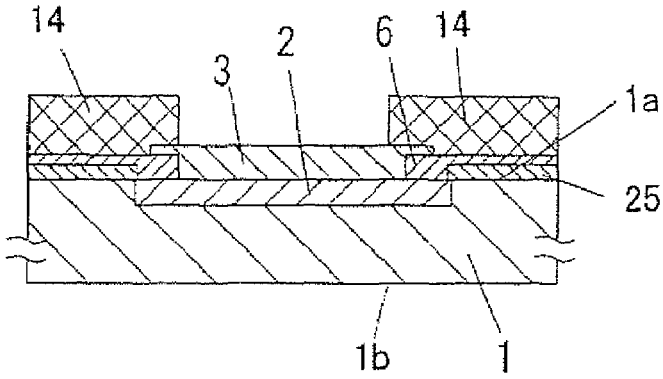
FIG. 27 is a sectional view showing a configuration of a pressure wave generator in accordance with a twelfth embodiment of the present invention.

Subsequently, a twelfth embodiment of the present invention is described. As shown in FIG. 27, a pressure wave generator of the twelfth embodiment comprises a semiconductor substrate 1, a thermal insulation layer 2 of porous layer formed by a first surface 1*a* side in thickness direction of the semiconductor substrate 1, a heating conductor 3 of a thin film (for example, a metal thin film such as aluminum thin film) formed on thermal insulation layer 2, an insulation film 25 formed on both sides of the heating conductor 3 on the first surface 1*a* of the semiconductor substrate 1, a protection film 16 formed for covering a part of a surface of the thermal insulation layer 2 and the insulation film 25, and a pair of pads 14 formed on portions of the heating conductor 3 and the protection film 16.

In the pressure wave generator of the twelfth embodiment, the thermal insulation layer 2 is formed in a predetermined area by a first surface 1*a* side of the semiconductor substrate 1, and the heating conductor 3 is formed on the thermal insulation layer 2 and inward than the outer peripheral of thermal insulation layer 2. The insulation film 25 is formed of $SiO_2$, film in an area on the first surface 1*a* of the semiconductor substrate 1 except the heating conductor 3. The protection film 16 is formed for covering the surface of the thermal insulation layer 2 except the area on which the heating conductor 3 is laminated and the insulator film 25. In addition, the pads 14 are formed for bridging on the heating conductor 3 and the protection cover 16. The protection film 16 is formed for surrounding entire outer periphery of the heating conductor 3 so as to prevent oxidation of the thermal insulation layer 2. In the twelfth embodiment, single crystalline silicon substrate is used for the semiconductor substrate 1, and porous silicon layer of porosity of 70% is used for the thermal insulation layer 2. The porous silicon layer as the thermal insulation layer 2 can be formed by anodizing a predetermined area which is a part of a silicon substrate used for the semiconductor substrate 1 in hydrogen fluoride aqueous solutions. By setting conditions of the anodization processing (for example, current density, current supplying term, and so on) appropriately, the porosity and thickness of the porous silicon layer as the thermal insulation layer 2 can be made with desired values. The higher the porosity of the porous silicon layer becomes, the smaller the heat conductivity and the volume heat capacity thereof become. For example, in a porous silicon layer having porosity of 60% which is formed by anodization of a single crystalline silicon having heat conductivity of 148 W/(m·k) and volume heat capacity of $1.63\times10^6$ J/(m$^3$·k), it was known that a value of heat conductivity thereof was 1 W/(m·k), and a value of volume heat capacity was $0.7\times10^6$ J/(m$^3$·k). In addition, since the thermal insulation layer 2 is formed of porous silicon layer having porosity of 70% in the twelfth embodiment, the heat conductivity of the thermal insulation layer 2 becomes 0.12 W/(m·K) and the volume heat capacity thereof becomes $0.5\times10^6$ J/(m$^3$·K).

As for a material of the protection film 16, it is possible to use a material chosen among a group of carbide, nitride, boride and silicide, and having a melting point higher than that of silicon. In this embodiment, the protection film 16 is formed of, for example, HfC having a melting point higher than that of silicon. As a material of carbide having a melting point higher than that of silicon, TaC, HfC, NbC, ZrC, TiC, VC, WC, ThC, SiC can be used. As a material of nitride having a melting point higher than that of silicon, HfN, TiN, TaN, BN, $Si_3N_4$ can be used. As a material of boride having a melting point higher than that of silicon, HfB, TaB, ZrB, TiB, NbB, WB, VB, MoB, CrB can be used. As a material of silicide having a melting point higher than that of silicon, $WSi_2$, $MoSi_2$, $TiSi_2$ can be used. It is mentioned later about a material of the heating conductor 3. In addition, in the pressure wave generator of the twelfth embodiment, a thickness of the thermal insulation layer 2 was set to be 2 μm, a thickness of the heating conductor 3 was set to be 50 nm, and a thickness of each pad 14 was set to be 0.5 μm. Besides, these numeric values of the thicknesses are examples, and it is not limited in particular.

Subsequently, process of manufacture of the pressure wave generator of the twelfth embodiment is described. At first, an energizing electrode (not illustrated) used in anodization processing is formed on a second side 1*b* of the silicon substrate 1. Afterwards, the insulation film 25 having an opening at a portion corresponding to the above mentioned area is formed on a first surface 1*a* of the silicon substrate 1, and the above-mentioned area on the silicon substrate is made porous by the anodization processing. Thus, the thermal insulation layer 2 of porous silicon layer is formed. In the anodization processing, an electrolyte of a mixture of an aqueous solution of hydrogen fluoride of 55 wt % and ethanol by 1:1 is used. An object to be processed having the semiconductor substrate 1 as a main component is dipped into the electrolyte in a processing tank. With using an energizing electrode as an anode and a platinum electrode arranged to face the first surface 1*a* of the semiconductor substrate 1 as a cathode, a current with a predetermined current density is flown between the energizing electrode and the platinum electrode from a current source, so that the thermal insulation layer 2 of porous silicon layer is formed.

After forming the thermal insulation layer 2 by the first surface 1*a* of the semiconductor substrate 1, the protection film 16, the heating conductor 3, and the pads 14 are formed sequentially. Finally, a dicing processing is performed, so that the pressure wave generator is manufactured. In the processes for forming the protection film 16, the heating conductor 3 and the pads 14, film are formed by any one of various sputtering method, various vacuum deposition, or various CVD method. For example, the patterning is performed with using a lithography technique and an etching technique appropriately.

Subsequently, examined result of a material of the heating conductor 3 is described. The pressure wave generators having a configuration shown in FIG. 27 were produced experimentally with a plane size of a portion for generating pressure waves among the heating conductor 3 (hereinafter, abbreviated as plane size) was formed as square of 20 mm×20 mm, and using Au, Pt, Mo, Ir and W among metallic material shown in following table 1 as materials. As for the pressure wave generator using Au, the heating conductor 3 is configured by double layers of a chromium film with a thickness of 10 nm on thermal insulation layer 2 and a gold film with a thickness of 40 nm on the chromium film. As for the pressure wave generators using Pt, Mo, Ir and W, the heating conductor 3 is configured by a single layer of a metal thin film of a single metal material with a thickness of 50 nm. Besides, each value in table 1 was based on a Japan Institute of Metals "metal data book"; (Maruzen Co., Ltd., Jan. 30, 1984 publication, revision 2),

TABLE 2

| Material | Melting Point | Heat Conductivity | Specific Heat | Specific Resistanace | Thermal Expansion Coefficient | Tensile Strength | Proof Strength | Elongation | Hardness | Young's Modulus | Modulus of Rigidity |
|---|---|---|---|---|---|---|---|---|---|---|---|
| W | 3355 | 159 | 134 | 5.65 | 0.045 | 588 | 539 | 2 | 360 Hv | 403 | |
| Mo | 2605 | 138 | 247 | 5.2 | 0.051 | 480 | 441 | 50 | 160 Hv | 327 | 121 |
| Al | 635 | 238 | 900 | 2.86 | 0.237 | 47 | 11.7 | 60 | 17 Hv | 76 | 26 |
| Cu | 1058 | 394 | 385 | 1.67 | 0.162 | 213 | 68.7 | 50 | 40 HR | 136 | |
| Ni | 1428 | 82.9 | 435 | 6.84 | 0.53 | 316 | 58.8 | 30 | 60 Hv | 205 | 77 |
| Ta | 2965 | 54.0 | 138 | 12.5 | 0.066 | 206 | 177 | 40 | 70 Hv | 181 | |
| Ti | 1655 | 15.0 | 519 | 55.0 | 0.089 | 233 | 137 | 54 | 60 Hv | 114 | |
| Ir | 2418 | 143 | 130 | 5.3 | 0.068 | 204 | | 6 | 200 Hv | 570 | 230 |
| Ag | 936 | 419 | 234 | 1.59 | 0.193 | 125 | 53.9 | 48 | 26 Hv | 101 | 31 |
| Pt | 1744 | 72.0 | 134 | 10.6 | 0.09 | 127 | 24.5 | 37 | 39 Hv | 170 | |
| Au | 1038 | 293 | 126 | 2.35 | 0.142 | 130 | | 45 | 25 HB | 88 | 30 |
| Rh | 1935 | 150 | 243 | | 0.082 | 686 | | 5 | 120 Hv | 379 | |
| Pd | 1627 | 72.0 | 243 | | 0.018 | 171 | 34.3 | 30 | 38 Hv | 121 | |
| Ru | 2225 | 105 | | | 0.091 | 490 | 363 | 3 | 350 Hv | 438 | 170 |
| Os | 3020 | 87.0 | | | 0.047 | | | | 350 Hv | | |

Figure 28:
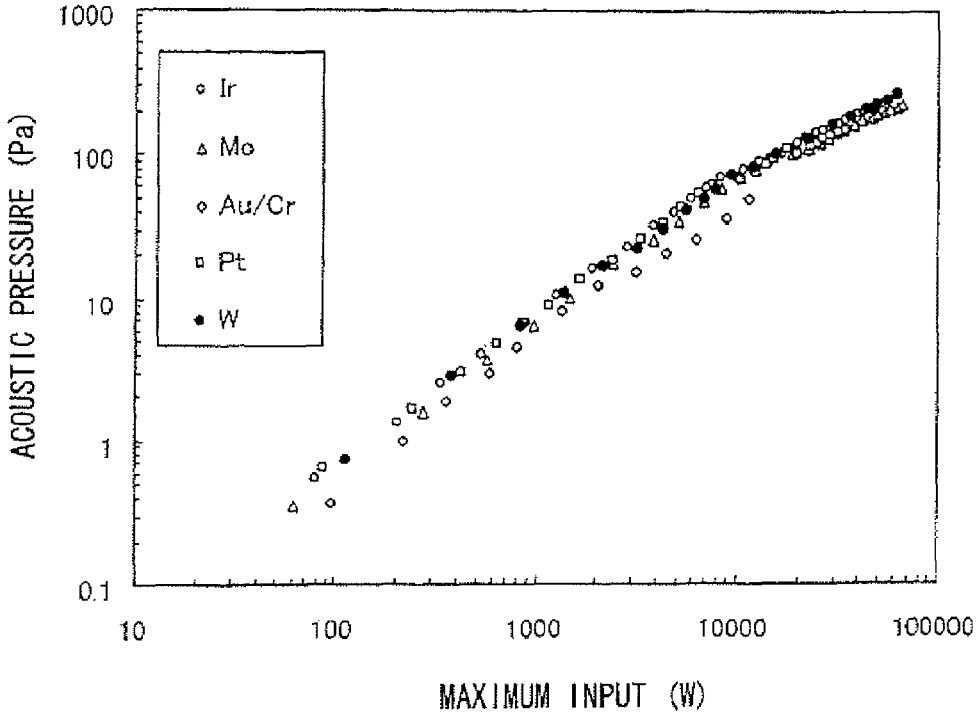
FIG. 28 is a graph showing an output characteristic of the pressure wave generator in accordance with the twelfth embodiment produced experimentally with various kinds of material.

Measure of Melting Point: ° C.
Measure of Heat Conductivity: W/(m · k)
Measure of Specific Heat: J/(kg · K)
Measure of Specific Resistance: μΩ · cm
Measure of Thermal Expansion Coefficient: $\times 10^{-4}$/K
Measure of Tensile Strength: $N/mm^2$
Measure of Proof Strength: $N/mm^2$
Measure of Elongation: %
Measure of Young's Modulus: GPa
Measure of Modulus of Rigidity: GPa With respect to each pressure wave generator produced experimentally, the results of measurement of acoustic pressure when electric power input to the heating conductor 3 was changed in various ways is shown in FIG. 28. In FIG. 28, abscissa shows peak values of input electric power (the largest input) while a peak value of voltage of sinusoidal wave with a frequency of 30 kHz is varied in various ways, and ordinate shows acoustic pressure of ultrasonic waves of 60 kHz (output acoustic pressure) measured at a position distant 30 cm from the surface of the heating conductor 3.

Hereupon, when Au/Cr, Pt, Mo, Ir and W were used as a material of the heating conductor 3, the largest output acoustic pressure were respectively 48 Pa, 150 Pa, 236 Pa, 226 Pa and 264 Pa.

The results mentioned above are gathered up as shown in the following table 3. At the same time, the table 3 shows reduced value of maximum outputs acoustic pressure when it was supposed that the plane size was made 5 mm×5 mm;

TABLE 3

| Metal Material | 20 mm × 20 mm | 5 mm × 5 mm (Reduced) |
|---|---|---|
| Au/Cr | 48 Pa | 3 Pa |
| Pt | 150 Pa | 9.4 Pa |
| Mo | 236 Pa | 14.8 Pa |
| Ir | 226 Pa | 14.1 Pa |
| W | 264 Pa | 16.5 Pa |

As can be seen from the table 3, when either of Pt, Mo, Ir and W is used as a material of the heating conductor 3, the resistance voltage for break down becomes higher, so that it is possible to provide a high power pressure wave generator, in comparison with the case of using Au as a material of the heating conductor 3.

By the way, it is necessary to make the above plane size smaller for outputting ultrasonic waves in broad band while directivity of pressure wave generated by the pressure wave generator is restricted. On the other hand, since the acoustic pressure generated by the pressure wave generator is in proportion to the plane size, absolute magnitude of the acoustic pressure becomes smaller when the plane size is lowered too much.

For sensing a distance and direction to an object by detecting reflected waves of pressure waves generated by sound source reflected by the object, acoustic pressure of several Pascal extent is necessary at lowest. For example, it is necessary to output pressure waves from the sound source from which acoustic pressure of 8 Pa extent at lowest can be obtained, for sensing reflected waves with using a detector having a sensitivity of several mV/Pa.

As cab be seen from the table 2, in the pressure wave generator using either of Pt, Mo, Ir and W as a material of the heating conductor 3, it is possible to obtain acoustic pressure more than 8 Pa, although the plane size is provided for 5 mm×5 mm. As a result of comparison of magnitude relations of physical characteristics in the above-mentioned table 1 with respect to Pt, Mo, Ir, W with Au, Inventors were found that Young's modulus of all of Pt, Mo, Ir and W shows the same magnitude relation with respect to that of Au, In other words, Pt, Mo, Ir and W respectively have values of Young's modulus higher than a value of Young's modulus of Au. Specifically, the values of Young's modulus of Pt, Mo, Ir and W are respectively 170 GPa, 327 GPa, 570 GPa, 403 GPa whereas the value of Young's modulus of Au is 88 GPa. Therefore, by using a metallic material having a value of Young's modulus equal to or larger than 170 GPa which is the value of Young's modulus of Pt as a material of the heating conductor 3, it is possible to raise the resistance voltage for break down, and to provide a high power pressure wave generator, in comparison with the case of using Au as a material of the heating conductor 3.

In addition, "a method for life test of heating wire and band" is conventionally standardized in a Japanese Industrial Standard (JIS C 2524), and it is described that the life test should be performed by 1.2 times of rated output. In compliance with such a life test, when rated output of acoustic pressure of the pressure wave generator is assumed as 8 Pa, it is necessary to perform the life test for outputting acoustic pressure of 9.6 Pa. As for the pressure wave generator having the plane size of 5 mm×5 mm, a material of the heating conductor 3 by which the largest output acoustic pressure becomes larger than 9.6 Pa was Mo, Ir and W. It is further found that values of Vickers hardness (diamond pyramid hardness) of all of Mo, Ir and W show the same magnitude relations with that of Pt from the above mentioned table 2. In other words the values of Vickers hardness Mo, Ir and W are respectively 160 Hv, 200 Hv and 360 Hv which are larger than the value of Vickers hardness of 39 Hv of Pt. Therefore, when a metal material having a value of Young's modulus is equal to or larger than 170 GPa and having a value of Vickers hardness equal to or larger than 160 Hv is used as a material of the heating conductor 3, it is possible to raise the resistance voltage for break down, and to provide a high power and high reliability pressure wave generator, in comparison with the case of using Au or Pt as a material of the heating conductor 3.

Figure 29:
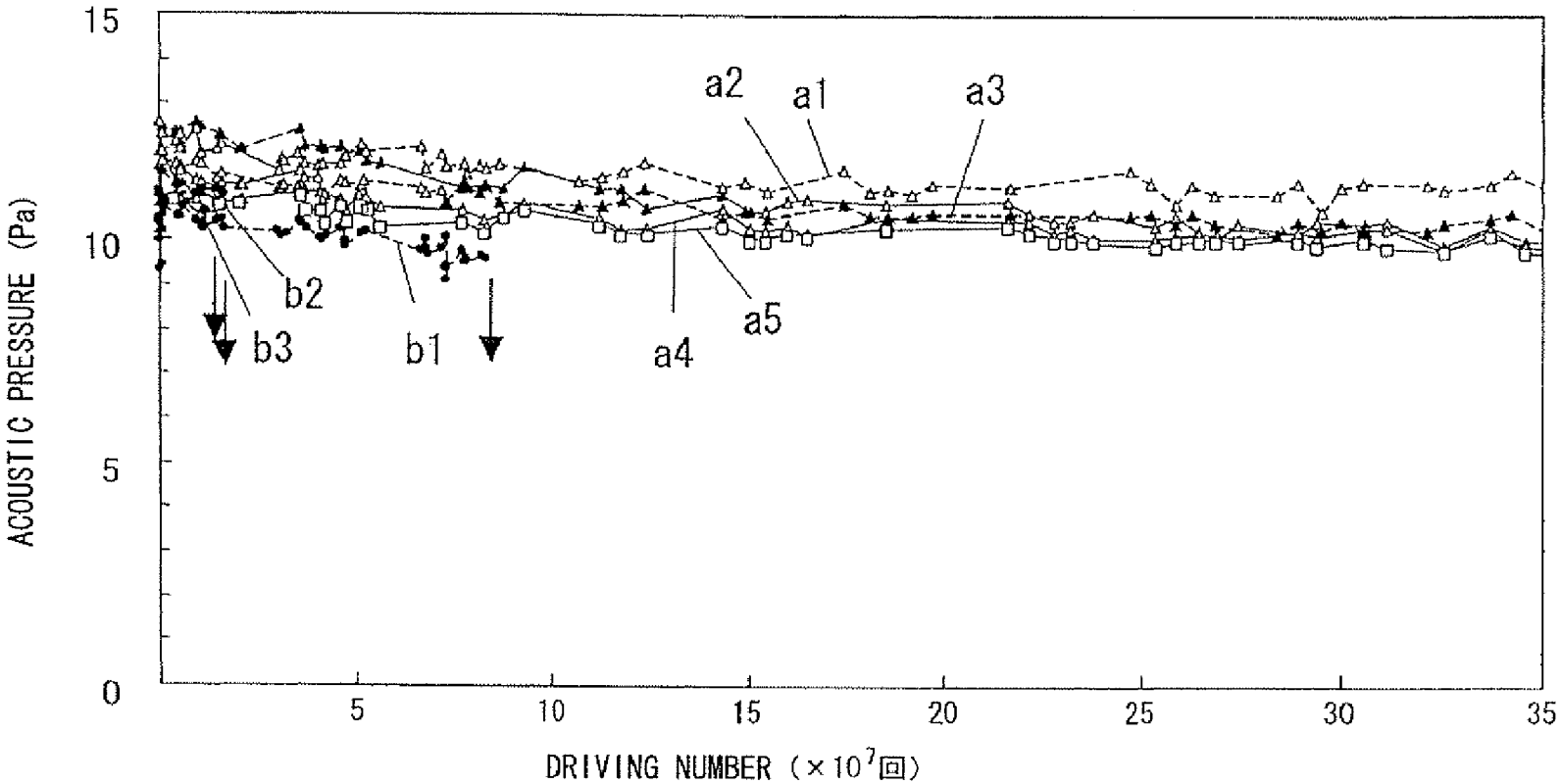
FIG. 29 is a graph showing life property of the pressure wave generator in accordance with the twelfth embodiment produced experimentally with various kinds of material.

Furthermore, a life test is performed for several number of samples with respect to the pressure wave generator using Ir by which the largest acoustic pressure was the smallest and the pressure wave generator using W by which the largest acoustic pressure was the largest among the materials of Mo, Ir and W, under a condition that acoustic pressure at initial drive was 12 Pa. The result is shown in FIG. 29. In FIG. 29, abscissa shows drive number of times, and ordinate shows acoustic pressure (output acoustic pressure). In FIG. 29, characteristic curves a1 to a5 respectively show uninterrupted driving life property of the samples using Ir as a metallic material of the heating conductor 3, and characteristic curves b1 to b3 respectively show life property of the sample using W as a metallic material of the heating conductor 3. In addition, downward arrows in FIG. 29 respectively show timings on the characteristic curves b1 to b3 when the pressure wave generator were broken.

As can be seen from FIG. 29, when it was compared in life property, the maximum number of driving times was 80,000,000 times in the pressure wave generators using W by which the largest acoustic pressure is larger, whereas the heating conductor 3 were not fractured in all of the pressure wave generators using Ir even though they were driven 300,000,000 times, and acoustic pressures were stable. In other words, the pressure wave generator using Ir has superior uninterrupted driving life property than the pressure wave generator using W by which the largest output acoustic pressure is much larger.

Various kinds of conditions are thought about as driving condition of the pressure wave generator. For example, when a life time of a manufacture which is uninterruptedly driven once in each one second in night and day is assumed as 10 years, it is necessary to assure about 300,000,000 times of drive number. The pressure wave generator using W was driven only about 80,000,000 times, whereas it was confirmed that all samples of the pressure wave generator using Ir were not broken even when they were driven 360,000,000 times. It was considered the reason that the pressure wave generator using Ir was superior in comparison with the pressure wave generator using W with respect to the uninterrupted driving life property. Although W is a metal having a high melting point, it is easily oxidized at only several hundred degrees Celsius. On the other hand, Ir is a noble metal and has higher oxidation resistance than W, so that it is thought that oxidation of the heating conductor 3 can be prevented.

In pressure wave generator of the twelfth embodiment, the protection film 16 is formed to the first surface 1*a* side of the semiconductor substrate 1, so that oxidation of the thermal insulation layer 2 can be prevented. Therefore, it is possible to prevent reduction of output power of the pressure wave generator due to oxidation of the thermal insulation layer 2, and reliability of the pressure wave generator can be improved. By using a material having a melting point higher than that of silicon among materials chosen from a group of carbides, nitride, boride and silicide as a material of protection film 16, the protection film 16 can be formed by a general method for forming a thin film used in semiconductor production process such as sputtering method, vacuum deposition, or CVD method.

Figure 30A:
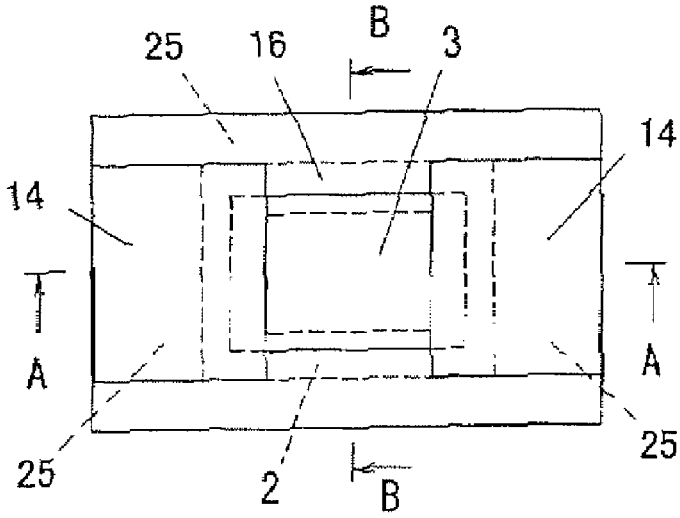
FIG. 30A is a plain view showing another configuration of the pressure wave generator in accordance with the twelfth embodiment.
Figure 30C:
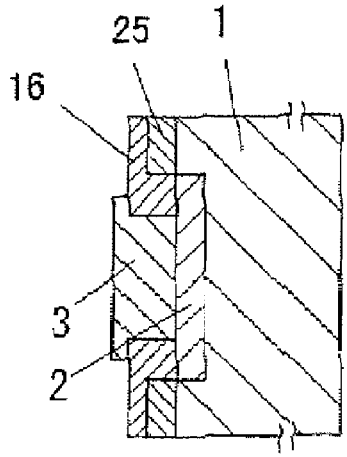
FIG. 30C is a B-B sectional view in FIG. 30A.
Figure 30B:
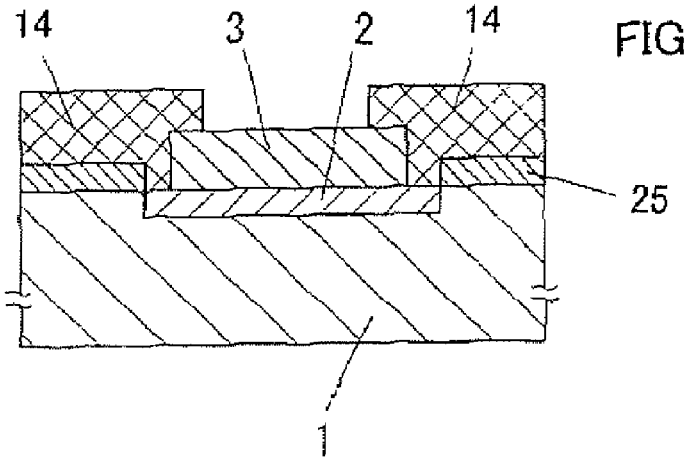
FIG. 30B is an A-A sectional view in FIG. 30A.

In the example shown in FIG. 27, the protection film 16 is formed to surround whole outer periphery of the heating conductor 3 in the first surface 1*a* side of the semiconductor substrate 1. As shown in FIGS. 30A to 30C, it is possible that a part of each par 14 is existed between the vicinities of both narrower side of the heating conductor 3 and the insulator film 25 in the first surface 1*a* side of the semiconductor substrate 1, and the protection film 16 is formed only on the area on the outer peripheral portion of the heating conductor 3 where no pad 14 is formed. In such a cases oxidation of the thermal insulation layer 2 can be prevented by a part of each pad 14 and the protection film 16.

Thirteenth Embodiment

Figure 31A:
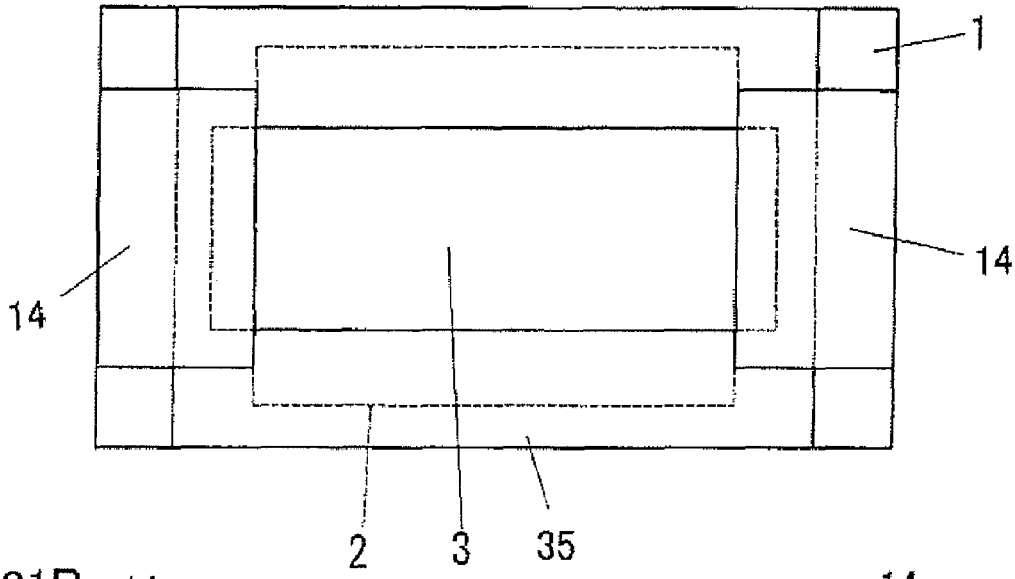
FIG. 31A is a plain view showing a configuration of a pressure wave generator in accordance with a thirteenth embodiment of the present invention.
Figure 31B:
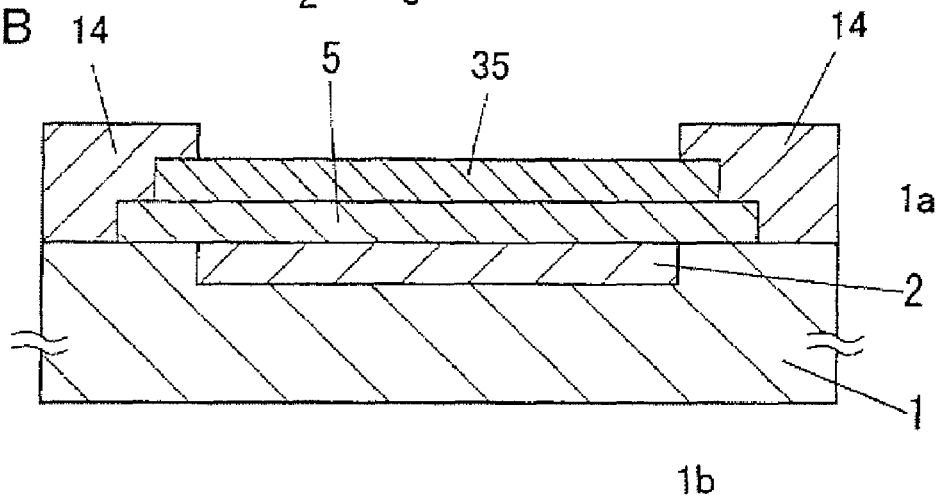
FIG. 31B is a sectional view showing the configuration of the pressure wave generator in accordance with the thirteenth embodiment.

Subsequently a thirteenth embodiment of the present invention is described. As for the pressure wave generator of the thirteenth embodiment, as shown in FIGS. 31A and 31B, a thermal insulation layer 2 is formed by a first surface 1*a* of a semiconductor substrate 1 of single crystalline silicon substrate, and anti-oxidation layer 35 is formed to cover the thermal insulation layer 2. A heating conductor 3 of a metal film is formed on the anti-oxidation layer 35. A pair of pads 14 is formed to contact with each side portion of the first surface 1*a* of the semiconductor substrate 1, the anti-oxidation layer 5 and the heating conductor 3. Since length of longer side and shorter side of the anti-oxidation layer 35 are respectively made longer than those of the thermal insulation layer 2, as shown in FIG. 31A, a portion of a surface of the thermal insulation layer 2 on which the heating conductor 3 is not formed is covered by the anti-oxidation layer 35.

The heating conductor 3 is formed of tungsten (W) which is one of a metal material having a high melting point. A value of heat conductivity of the heating conductor 3 is 174 W/(m·k) and a value of volume heat capacity thereof is $2.5\times10^6$ J/($m^3$·k). Material of the heating conductor 3 is not limited to tungsten, and it is possible to use a metal having a melting point higher than that of silicon. Specifically, tantalum, molybdenum, iridium, and so on can be used.

As for a material of the anti-oxidation layer 35, it is possible to use a material chosen among a croup of carbide, nitride, boride and silicide, and having a melting point higher than that of silicon. In this embodiment, the anti-oxidation layer 35 is formed of, for example, HfC having a melting point higher than that of silicon. As a material of carbide having a melting point higher than that of silicon, TaC, HfC, NbC, ZrC, TiC, VC, WC, ThC, SiC can be used. As a material of nitride having a melting point higher than that of silicon, HfN, TiN, TaN, BN, $Si_3N_4$ can be used. As a material of boride having a melting point higher than that of silicon, HfB, TaB, ZrB, TiB, NbB, WB, VB, MoB, CrB can be used. As a material of silicide having a melting point higher than that of silicon, $WSi_2$, $MoSi_2$, $TiSi_2$ can be used.

In the pressure wave generator of the twelfth embodiment, a thickness of a silicon substrate before forming the thermal insulation layer 2 was set to be 525 μm, a thickness of the thermal insulation layer 2 was set to be 2 μm, a thickness of the heating conductor 3 was set to be 50 nm, and a thickness of each pad 14 was set to be 0.5 μm. Besides, these numeric values of the thicknesses are examples, and it is not limited in particular Subsequently, process of manufacture of the pressure wave generator of the thirteenth embodiment is described. At first an energizing electrode (not illustrated) used in anodization processing is formed on a second side 1*b* of the silicon substrate l. Afterwards, the insulation film 25 having an opening at a portion corresponding to the above mentioned area is formed on a first surface 1*a* of the silicon substrate 1, and the above-mentioned area on the silicon substrate is bade porous by the anodization processing. Thus, the thermal insulation layer 2 of porous silicon layer is formed. In the anodization processing, an electrolyte of a mixture of an aqueous solution of hydrogen fluoride of 55 wt % and ethanol by 1:1 is used. An object to be processed having the semiconductor substrate 1 as a main component is dipped into the electrolyte in a processing tank With using an energizing electrode as an anode and a platinum electrode arranged to face the first surface 1*a* of the semiconductor substrate 1 as a cathode, a current with a predetermined current density is flown between the energizing electrode and the platinum electrode from a current source, so that the thermal insulation layer 2 of porous silicon layer is formed.

After forming the thermal insulation layer 2 by the first surface 1*a* of the semiconductor substrate 1, the anti-oxidation layer 35, the heating conductor 3, and the pads 14 are formed sequentially. Finally, a dicing processing is performed, so that the pressure wave generator is manufactured. In the processes for forming the protection film 16, the heating conductor 3 and the pads 14, film are formed by any one of various sputtering method, various vacuum deposition, or various CVD method. For example, the patterning is performed with using a lithography technique and an etching technique appropriately.

Figure 32:
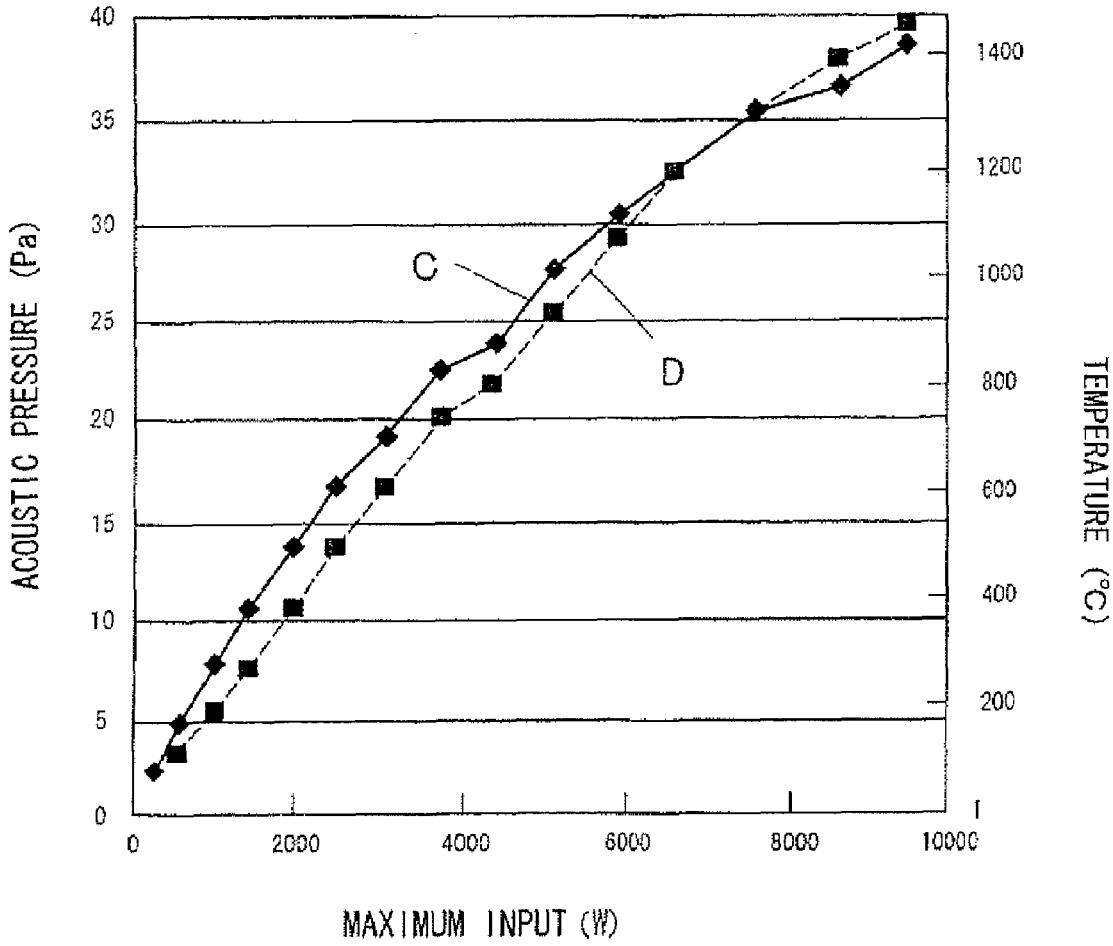
FIG. 32 is a graph showing relations between an electric input applied to a heating conductor of the pressure wave generator and generated acoustic pressure and temperature of a heating conductor.

Pressure wave generator except anti-oxidation layer 35 from the conformation shown in FIGS. 31A and 31B was produced experimentally as comparative example of the pressure wave generator of the thirteenth embodiment. Then, input electric power to the heating conductor 3 was changed in various ways, and acoustic pressure and temperature of the heating conductor 3 were measured. The result is shown in FIG. 32. In FIG. 32, abscissa shows peak values of input electric power while a peak value of voltage of sinusoidal wave with a frequency of 30 kHz is varied in various ways, ordinate in left hand shows acoustic pressure of ultrasonic waves of 60 kHz (output acoustic pressure) measured at a position distant 30 cm from the surface of the heating conductor 3, and ordinate in right hand shows a surface temperature of the heating conductor 3. In the figures, a characteristic curve C shows a variation of acoustic pressure, and a characteristic curve D shows a variation of the surface temperature of the heating conductor 3.

As can be seen from FIG. 32, it is found that acoustic pressure and temperature of the heating conductor 3 tend to rise with incrementation of the input electric power to heating conductor 3. For obtaining acoustic pressure of 15 Pa extent, it is necessary to raise the temperature of the heating conductor 3 to around 400 degrees Celsius. For obtaining acoustic pressure of 30 Pa extent, it is necessary to raise the temperature of the heating conductor 3 to equal to or larger than 1000 degrees Celsius. However, in such a configuration of the comparative example in which a part of a surface of the thermal insulation layer 2 of porous silicon layer is exposed, when the temperature of the heating conductor 3 becomes around 400 degrees Celsius, oxidation of the thermal insulation layer 2 begins in the air, so that volume heat capacity of the thermal insulation layer 2 increases. Since porous silicon layer generally has a larger superficial dimension than bulk silicon having the same thickness, porous silicon layer is very active to be oxidized in the air. Therefore, it is thought that oxidation of the thermal insulation layer 2 is accelerated due to it is heated by heat of the heating conductor 3.

In contrast, in the pressure wave generator of the thirteenth embodiment, the anti-oxidation layer 35 is existed between the heating conductor 3 and the thermal insulation layer 2 to prevent oxidation of the thermal insulation layer 2, so that a surface of a portion of the thermal insulation layer 2, on which the heating conductor 3 is not formed, is not exposed. Hereupon, when a film thickness of a high-melting point film constituting the anti-oxidation layer 35 is too thick, volume heat capacity of the anti-oxidation layer 35 becomes too large to perform a thermal insulation function of the thermal insulation layer 2. Consequently, output power of the pressure wave generator falls. In the thirteenth embodiment, a film thickness of the high-melting point film permitted for anti-oxidation layer 35 is set to be equal to or smaller than the thermal diffusion length L defined by heat conductivity and volume heat capacity of the heating conductor 3 and a waveform of electric input applied to the heating conductor 3 The thermal diffusion length L is derived by formula 2 described in the second embodiment.

Numerical example when ultrasonic waves are generated by the pressure wave generator of the thirteenth embodiment is described. When a material of the anti-oxidation layer 35 is HfC, and a frequency f=20 kHz (that is, to generate ultrasonic waves having a frequency of 20 kHz), since the thermal diffusion length L=11 μm, the thickness of the anti-oxidation layer 35 should be equal to or smaller than 11 μm. Similarly, when a frequency f=100 kHz (that is, to generate ultrasonic waves having a frequency of 100 kHz), since the thermal diffusion length L=5.1 μm, the thickness of the anti-oxidation layer 35 should be equal to or smaller than 5.1 μm. In the thirteenth embodiment, HfC was used as a material of anti-oxidation layer 35, and the thickness of the anti-oxidation layer 35 was set to 50 nm.

When a material of the anti-oxidation layer 35 is TaN, and a frequency f=20 kHz, since the thermal diffusion length L=5.9 μm, the thickness of the anti-oxidation layer 35 should be equal to or smaller than 5.9 μm. Similarly, when a frequency f=100 kHz, since the thermal diffusion length L=2.6 μm, the thickness of the anti-oxidation layer 35 should be equal to or smaller than 2.6 μm;

As mentioned above, in the pressure wave generator of the thirteenth embodiment, the anti-oxidation layer 35 is formed between the heating conductor 3 and the thermal insulation layer 2 of porous silicon layer to prevent oxidation of the thermal insulation layer 2. Thus, even when the temperature of the heating conductor 3 becomes much higher, it is possible to prevent oxidation of the thermal insulation layer 2 of porous silicon layer, and to prevent reduction of power of the pressure wave generator due to oxidation of porous silicon layer as the thermal insulation layer 2. In addition, since the heating conductor 3 is formed of a material having a melting point higher than that of silicon, and the anti-oxidation layer 35 is formed of a material having a melting point higher than that of silicon, too, it is possible to drive the heating conductor 3 until the temperature of the heating conductor is raised to a maximum temperature at which silicon can be used (melting point of silicon is 1,410 degrees Celsius). Therefore, it is possible to provide a high power pressure wave generator, in comparison with the case that the heating conductor 3 is formed by a metal material having relatively low melting point such as aluminum Furthermore, since the thickness of the anti-oxidation layer 35 is set to be equal to or smaller than the thermal diffusion length L, it is possible to prevent the reduction of power of the pressure wave generator due to the existence of the anti-oxidation layer 35.

By using a material having a melting point higher than that of silicon among materials chosen from a group of carbides, nitride, boride and silicide as a material of the anti-oxidation layer 35, the anti-oxidation layer 35 can be formed by a general method for forming a thin film used in semiconductor production process such as sputtering method, vacuum deposition, or CVD method

Fourteenth Embodiment

Figure 33A:
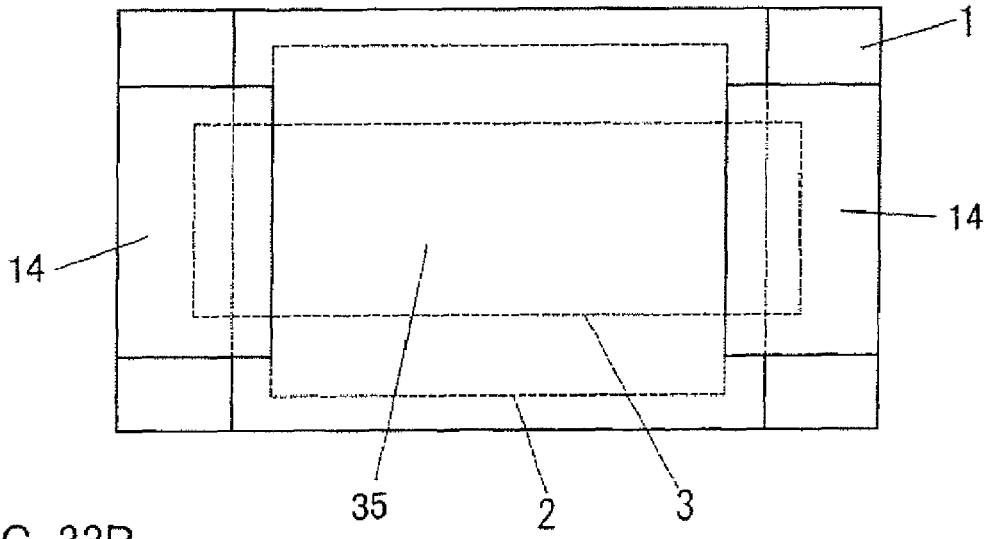
FIG. 33A is a plain view showing a configuration of a pressure wave generator in accordance with a fourteenth embodiment of the present invention.
Figure 33B:
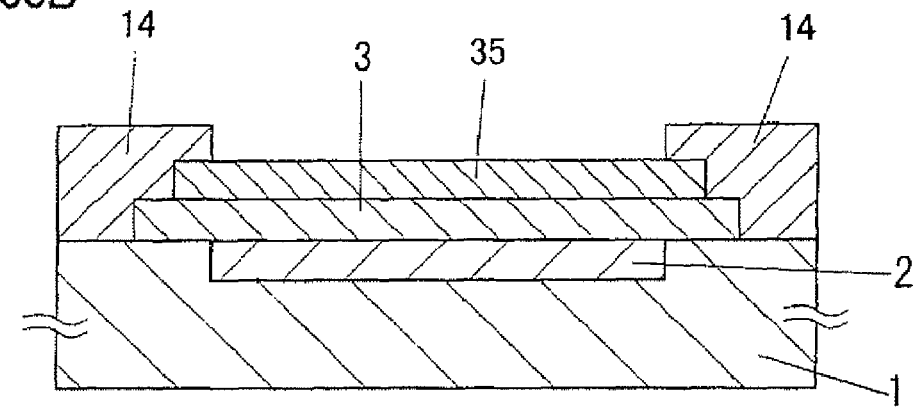
FIG. 33B is a sectional view showing the configuration of the pressure wave generator in accordance with the fourteenth embodiment.

Subsequently, a fourteenth embodiment of the present invention is described. As for the pressure wave generator of the fourteenth embodiment, a thermal insulation layer 2 is formed by a first surface 1*a* side of a semiconductor substrate 1 of single crystalline silicon substrate, and a heating conductor 3 of metal thin film is formed on the thermal insulation layer 2, as shown in FIGS. 33A and 33B. Furthermore, an anti-oxidation layer 35 is formed to cover the heating conductor 3 and a portion of the thermal insulation layer 2 on which the heating conductor 3 is not formed. A pair of pads 14 is formed to contact with each side portion of the first surface 1*a* of the semiconductor substrate 1 and the heating conductor 3, and the anti-oxidation layer 5. In comparison with the pressure wave generator of the above mentioned thirteenth embodiment shown in FIGS. 31A and 31B, it is different that the anti-oxidation layer 35 is formed on the heating conductor 3. Others arc similar to the pressure wave generator of the thirteenth embodiment.

As mentioned above, it is necessary to raise the temperature of the heating conductor 3 to around 400 degrees Celsius in order to generate acoustic pressure of 15 Pa extent, and it is necessary to raise the temperature of the heating conductor 3 equal to or higher than 1,000 degrees Celsius in order to generate acoustic pressure of 30 Pa extent. However, in such a configuration that a surface of the heating conductor 3 is exposed, when the temperature of the heating conductor 3 becomes around 400 degrees Celsius, oxidation of the heating conductor 3 begins in the air, so that resistance of the heating conductor 3 increases. In contrast, in the pressure wave generator of the thirteenth embodiment, the anti-oxidation layer 5 formed of a material having a melting point higher than that of silicon is provided on a surface of the heating conductor 3. Thus, even when the temperature of the heating conductor 3 is raised equal to or higher than 400 degrees Celsius, the heating conductor 3 never be oxidized, and resistance and volume heat capacity of the heating conductor 3 is maintained substantially constant for a long term.

Figure 34A:
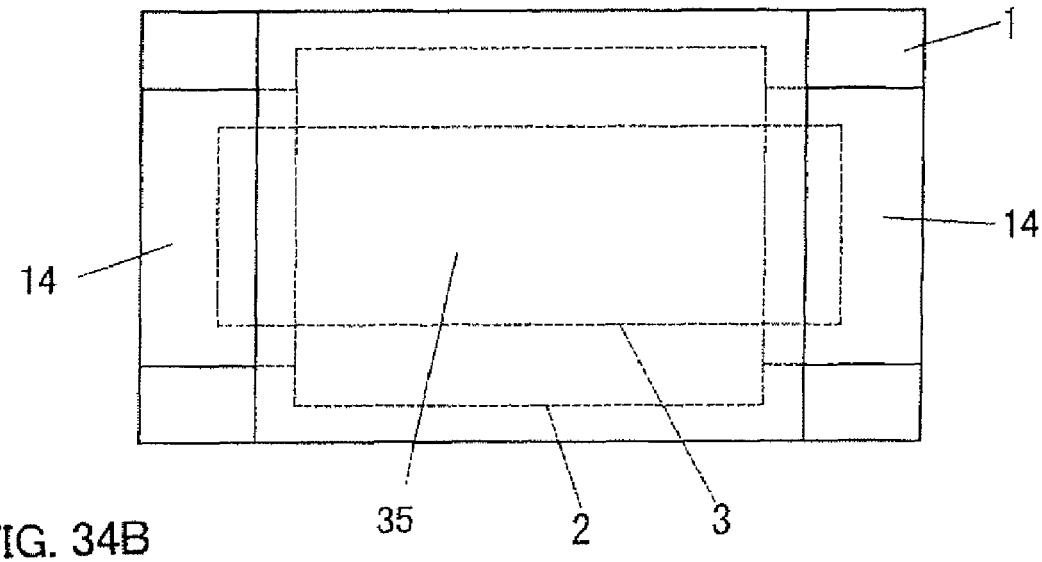
FIG. 34A is a plain view showing another configuration the pressure wave generator in accordance with the fourteenth embodiment.

In addition, although the heating conductor 3, the thermal insulation layer 2 and the anti-oxidation layer 35 are respectively formed to have a rectangular planar shape as shown in FIG. 34A, the lengths of longer side and shorter side of the anti-oxidation layer 35 are respectively set to be longer than those of the thermal insulation layer 2, so that a portion of the thermal insulation layer 2 on which the heating conductor 3 is not formed is covered by the anti-oxidation layer 35. Consequently, it is possible to prevent oxidation of the thermal insulation layer 2 by the anti-oxidation layer 35, and to prevent the reduction of power of the pressure wave generator due to increase of volume heat capacity of the thermal insulation layer 2 caused by oxidation thereof.

Figure 34B:
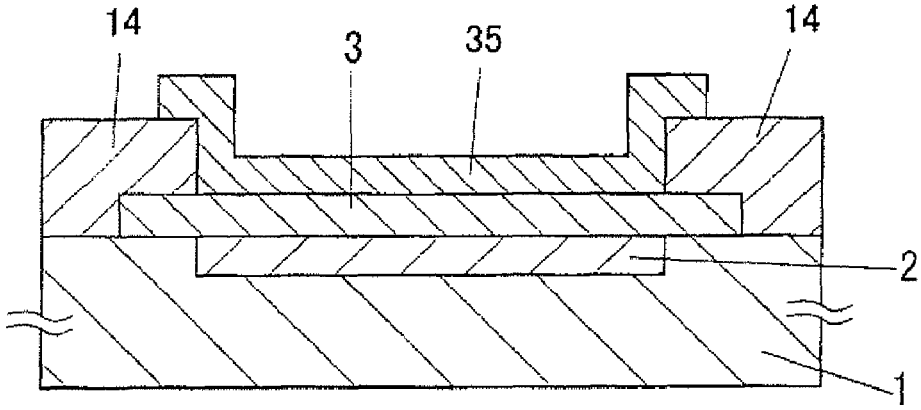
FIG. 34B is a sectional view showing another configuration of the pressure wave generator in accordance with the fourteenth embodiment.

In addition, as shown in FIGS. 34A and 34B, when a part of each pad 14 is covered by the anti-oxidation layer 35, similar advantageous effect can be obtained.

Other Modifications

In the above mentioned embodiments, Si is used as material of the semiconductor substrate 1, but a material of the semiconductor substrate 1 is not limited to Si, and, for example, even another semiconductor material that can be made porous by anodization processing such as Ge, SiC, GaP, GaAs, InP, and so on can be used.

In addition, in the above-mentioned embodiments, it is described that the electric input having a waveform varied periodically such as a sinusoidal wave or a square wave is supplied to the heating conductor 3 of the pressure wave generator. The present invention, however, is not limited to the embodiment. When a waveform of electric input supplied to the heating conductor 3 is made to solitary wave, it is possible to generate a single pulse compressional wave (an impulse acoustic wave) as a pressure wave.

This application is based on Japanese patent applications 2004-134312, 2004-134313, 2004-188785, 2004-188790, 2004-188791 and 2004-280417 filed in Japan, the contents of which are hereby incorporated by references of specifications and drawings of the above patent applications.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

The invention claimed is:

1. A pressure wave generator, comprising:

a substrate;

a thermal insulation layer of porous material formed on a surface of the substrate in thickness direction; and a heating conductor of thin film formed on the thermal insulation layer, wherein temperature of the heating conductor varies depending on waveforms of electric input to the heating conductor, and pressure waves are generated by heat exchange between the heating conductor and an atmosphere, wherein, when a thickness at a center of the thermal insulation layer in width direction is used as a reference thickness, and it is assumed that distribution of thickness of thermal insulation layer in the width direction is averaged with the reference thickness, porosity in an outer peripheral portion of the thermal insulation layer is made smaller than porosity in a center portion of the thermal insulation layer.

2. The pressure wave generator in accordance with claim 1, wherein a thickness in the outer peripheral portion of the thermal insulation layer is made smaller than a thickness in the center portion thereof.

3. The pressure wave generator in accordance with claim 1, wherein porosity per unit volume in the outer peripheral portion of the thermal insulation layer is made smaller than porosity per unit volume in the center portion thereof.

4. The pressure wave generator in accordance with claim 1, wherein when a thickness at the center of the thermal insulation layer in the width direction is used as a reference thickness, and an area is defined by the reference thickness along the surface of the semiconductor substrate in the width direction;

a following equation is satisfied:

$$\alpha_{in} \times C_{in} < \alpha_{out} \times C_{out};$$

wherein $\alpha_{in}$ refers to a mean heat conductivity of the thermal insulation layer in an inner portion from an outer periphery of the heating conductor in the thickness direction, $C_{in}$ refers to a mean volume heat capacity of the thermal insulation layer, $\alpha_{out}$ refers to a mean heat conductivity of the semiconductor substrate in an outer portion from the outer periphery of the heating conductor in thickness direction, and $C_{out}$ refers to a mean volume heat capacity of the semiconductor substrate, and wherein a value of αin×Cin increases in a vicinity of a boundary between the inside portion and the outside portion.

5. The pressure wave generator in accordance with claim 4, wherein a boundary of an area, where a value of αin×Cin varies, is substantially coincided with the outer periphery of the heating conductor, or is located inward than the outer periphery of the heating conductor.

6. The pressure wave generator in accordance with claim 4, wherein in an area, where a value of αin×Cin varies, at least one of heat conductivity and volume heat capacity per unit volume of a material forming the thermal insulation layer is continuously varied to increase towards outside.

7. The pressure wave generator in accordance with claim 1, wherein a temperature gradient mitigation portion formed of a material having a heat conductivity equal to or higher than that of the thermal insulation layer is provided to contact with an outer peripheral portion of the heating conductor.

8. The pressure wave generator in accordance with claim 1, wherein in a thickness direction of the substrate, porosity of a portion of the thermal insulation layer near to the substrate is smaller than a porosity of a portion of the thermal insulation layer near to the heating conductor.

9. The pressure wave generator in accordance with claim 8, wherein in the thickness direction of substrate, the thermal insulation layer has a high porosity layer formed by the heating conductor side and a low porosity layer formed by substrate side; and a thickness of the high porosity layer is set to be equal to or larger than a thermal diffusion length defined by heat conductivity and volume heat capacity of the high porosity layer and a waveform of electric input supplied to the heating conductor.

10. The pressure wave generator in accordance with claim 1, wherein the heating conductor is formed of a material having a value of Young's modulus equal to or larger than 170 GPa.

11. The pressure wave generator in accordance with claim 1, wherein the heating conductor is formed of a material having a value of Vickers hardness equal to or larger than 160 Hv.

12. The pressure wave generator in accordance with claim 1, wherein a material of the heating conductor is a noble metal.

13. The pressure wave generator in accordance with claim 1, wherein an anti-oxidation layer is formed between the heating conductor and the thermal insulation layer for preventing oxidation of the thermal insulation layer.

14. The pressure wave generator in accordance with claim 1, wherein the thermal insulation layer is formed in a predetermined area on the first surface of the substrate;

the heating conductor is formed on the thermal insulation layer inward than outer periphery of the thermal insulation layer, and an anti-oxidation layer is formed on at least a portion of a surface of the thermal insulation layer, on which the heating conductor is not formed, for preventing oxidation of the thermal insulation layer.

15. The pressure wave generator in accordance with claim 1, wherein an anti-oxidation layer is formed on at least a surface of the heating conductor for preventing oxidation of the heating conductor.

16. The pressure wave generator in accordance with claim 13, wherein a thickness of the anti-oxidation layer is equal to or smaller than a thermal diffusion length defined by heat conductivity and volume heat capacity of the high porosity layer and a waveform of electric input supplied to the heating conductor.

17. The pressure wave generator in accordance with claim 13, wherein the anti-oxidation layer is formed of either material chosen among a group of carbides, nitride, boride and silicide.

* * * * *